US012473062B1

(12) United States Patent
Timmerman

(10) Patent No.: US 12,473,062 B1
(45) Date of Patent: Nov. 18, 2025

(54) REVERSIBLE CAMBER WINGSAIL

(71) Applicant: Daryl Timmerman, Derby, KS (US)

(72) Inventor: Daryl Timmerman, Derby, KS (US)

( * ) Notice: Subject to any disclaimer, the term of this patent is extended or adjusted under 35 U.S.C. 154(b) by 0 days.

(21) Appl. No.: 19/068,780

(22) Filed: Mar. 3, 2025

(51) Int. Cl.
*B63H 9/061* (2020.01)

(52) U.S. Cl.
CPC ..... *B63H 9/061* (2020.02)

(58) Field of Classification Search
CPC ..... B63H 9/061
See application file for complete search history.

(56) References Cited

U.S. PATENT DOCUMENTS 4,386,574 A * 6/1983 Riolland ..... B63H 9/061 114/39.31
7,114,456 B2 10/2006 Sohy
2014/0261126 A1* 9/2014 Jenkins ..... B63H 9/061 114/102.16

FOREIGN PATENT DOCUMENTS

GB 2046673 A * 11/1980 ..... B63B 35/73
WO WO-2014085835 A2 * 6/2014 ..... B63H 9/0607
WO 2020234456 A1 11/2020

* cited by examiner

*Primary Examiner* — Stephen P Avila
(74) *Attorney, Agent, or Firm* — Stinson LLP

(57) ABSTRACT

Disclosed is a sailboat with a reversible camber wingsail and an air rudder assembly. The wingsail is capable of forming first and second high lift airfoil shapes of opposite cambers, and a third neutral, uncambered airfoil shape that allows zero lift (weathervane) docking and storage. The wingsail tacks by reversing the camber of the wingsail and alternating between the two high lift, low drag airfoil shapes. The wingsail employs an adjustable internal framework of spars and rotatable ribs to selectively configure a sailcloth to define the first and second high lift, low drag airfoil shapes and a third neutral airfoil shape. The wingsail incorporates camber linkages and tensioning mechanisms to address complexities of reversing the camber of the airfoil formed by the sailcloth stretched around the framework. The wingsail is detachable from the boat.

26 Claims, 37 Drawing Sheets

REVERSIBLE CAMBER WINGSAIL

FIELD

This disclosure generally pertains to a reversible camber wingsail.

BACKGROUND

Innovations in sail design have continued to advance the performance of wind-powered vessels. One such development is the use of airfoil-shaped sails, which leverage aerodynamic principles similar to those used in aircraft wings. When oriented vertically on a sailboat, these airfoil structures are commonly referred to as wingsails.

Wingsails differ from traditional sails by employing a dual-surface design with lower drag than a single thin membrane. This dual curvature creates a pressure differential as air flows over the surfaces at different velocities, thereby generating lift. The increased efficiency of cambered airfoil wingsails is due to their ability to create greater lift with reduced drag compared to conventional sails. However, a key characteristic of high-lift airfoils is their asymmetrical shape, which means they are optimized to generate lift in only one direction.

This asymmetry poses a significant challenge in sailing applications, where the ability to reverse the camber of the sail is crucial for changing tack. While conventional sails can easily reverse due to their flexible material, cambered wingsails are not as easily adjusted. The mechanisms to achieve camber reversal have not achieved high lift and have suffered high drag.

To address these challenges, various wingsail configurations have been developed to improve versatility and performance. One prominent category includes semi-rigid or soft wingsails, which consist of a flexible sailcloth supported by internal ribs or battens. These designs allow for some adjustability while maintaining the aerodynamic benefits of an airfoil shape. However, there remains a need for further improvements in wingsail technology, particularly for systems that can both (a) leverage the highest lift airfoil shapes with the lowest drag for maximum efficiency and (b) still effectively reverse the camber to allow for tacking.

SUMMARY

Disclosed herein is a reversible camber wingsail. The wingsail has a spanwise axis, a port side, and a starboard side. The wingsail also has a spar extending along the spanwise axis and a plurality of rib units connected to the spar at spaced apart locations along the spanwise axis. Each rib unit has a respective rib plane and each rib unit is configured to define a high lift airfoil profile in the respective rib plane. The high lift airfoil profile includes an aerodynamic lower profile edge and an aerodynamic upper profile edge. Each rib unit has a respective axis of rotation in the respective rib plane extending transverse to the spanwise axis. Each rib unit can rotate about the axis of rotation from a port wind position to a starboard wind position, wherein in the respective port wind position, each rib unit is oriented so the respective aerodynamic lower profile edge is on the port side of the wingsail and the respective aerodynamic upper profile edge is on the starboard side of the wingsail, and wherein in the respective starboard wind position, each rib unit is oriented so the respective aerodynamic lower profile edge is on the starboard side of the wingsail and the respective aerodynamic upper profile edge is on the port side of the wingsail. The wingsail also includes a sailcloth comprising a port side sheet portion and a starboard side sheet portion, the sailcloth covering the plurality of rib units such that the rib units are received between the port side sheet portion and the starboard side sheet portion.

When the rib units are oriented in the port wind positions, the rib units adjust the sailcloth to form a port wind high lift airfoil by forming the port side sheet portion over the aerodynamic lower profile edges of the rib units to define an aerodynamic lower surface of the port wind high lift airfoil and by forming the starboard side sheet portion over the aerodynamic upper profile edges of the rib units to form an aerodynamic upper surface of the port wind high lift airfoil. When the rib units are oriented in the starboard wind positions, the rib units adjust the sailcloth to form a starboard wind high lift airfoil by forming the port side sheet portion over the aerodynamic upper profile edges of the rib units to define an aerodynamic upper surface of the starboard wind high lift airfoil and by forming the starboard side sheet portion over the aerodynamic lower profile edges of the rib units to form an aerodynamic lower surface of the starboard wind high lift airfoil.

In an embodiment of the present disclosure, a sailboat with a reversible camber wingsail is disclosed. The sailboat has a hull and a reversible camber wingsail upstanding from the hull. An air rudder is suspended above the hull aft of the wingsail. The air rudder assembly has a stabilizer arm mounted on the mainspar of the wingsail. The stabilizer arm has a forward end portion and an aft end portion. The air rudder is supported on the aft end position and a counterbalance weight is supported on the forward end of the stabilizer arm. The air rudder has a main stabilizer body that is free to rotate about the stabilizer arm and a controllable trim tab aft of the main stabilizer body.

In another embodiment of the present disclosure, a reversible camber wingsail with a sail tensioning mechanism for each rib unit is disclosed. The wingsail has a spanwise axis, a port side, and a starboard side. The wingsail has a spar extending along the spanwise axis. A plurality of rib units is connected to the spar at spaced apart locations along the spanwise axis. Each rib unit has a respective axis of rotation. The rib units are rotatable about the axis of rotation from a port wind position to a starboard wind position. The wingsail includes a one-piece sailcloth comprising a port side sheet portion and starboard side sheet portion. The sailcloth covers the plurality of rib units such that the rib units are received between the port side sheet portion and the starboard side sheet portion. The sailcloth is affixed to the main sail structure at the trailing edge spar, with elastic attachments at the upper and lower margins of the main sail structure.

When the rib units are rotated to the port wind positions, the sailcloth forms on the rib units to define a first airfoil shape. When the rib units are rotated to the starboard wind positions, the sailcloth forms on the rib units to define a second airfoil shape. The first airfoil shape and the second airfoil shape have opposite cambers. The wingsail also includes a cam mechanism for each rib unit configured to extend and retract the respective rib unit by cam action as the rib unit rotates about the respective axis of rotation. The cam mechanism is configured to retract the rib unit at angular positions about the axis of rotation between the port wind position and the starboard wind position to relax the sailcloth and extend the rib unit at the port wind position and the starboard wind position to tension the sailcloth.

Other aspects will be in part apparent and in part pointed out hereinafter.

BRIEF DESCRIPTION OF THE DRAWINGS

Corresponding parts are given corresponding reference characters throughout the drawings.

DETAILED DESCRIPTION

Figure 1:
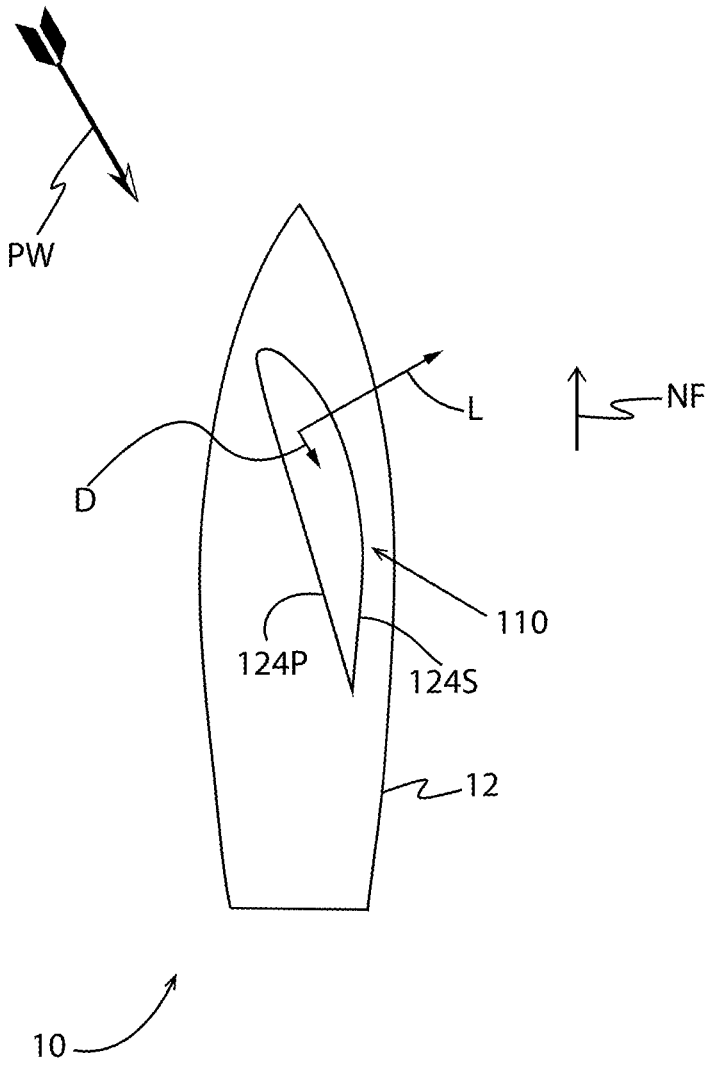
FIG. 1 is a schematic of an exemplary embodiment of a sailboat in accordance with the present disclosure.
Figure 2:
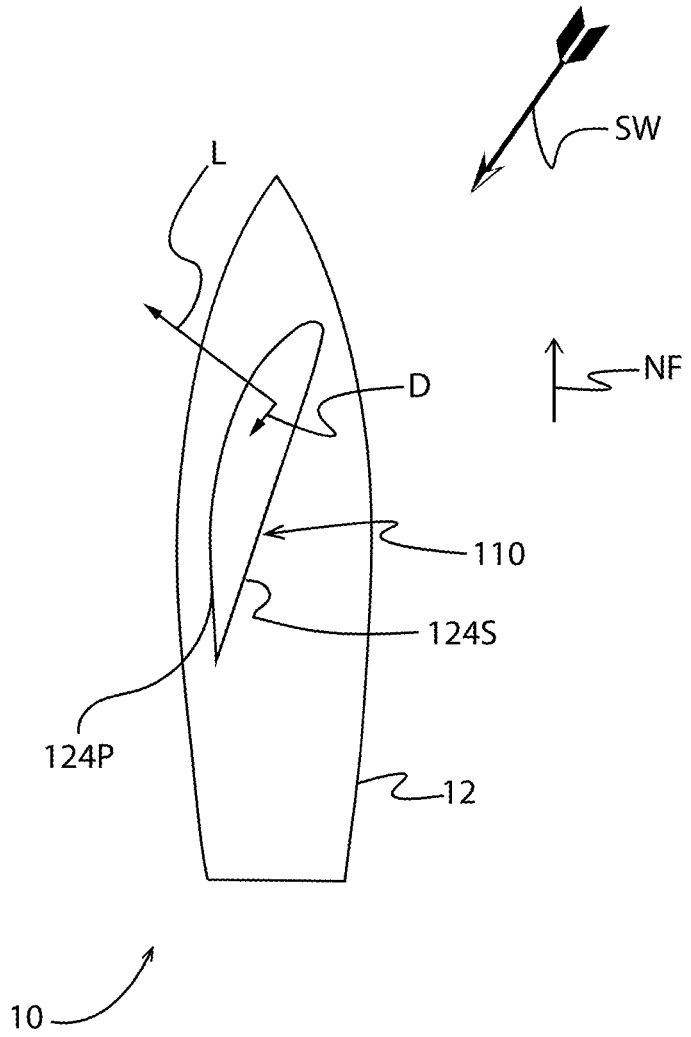
FIG. 2 is a schematic of an exemplary embodiment of a sailboat in accordance with the present disclosure.

Referring now to FIGS. 1 and 2, an exemplary embodiment of a sailboat in accordance with the present disclosure is generally indicated at reference number 10. In FIGS. 1 and 2, the hull 12 of the sailboat is shown schematically, to represent various types of boat hulls. In lieu of a traditional sail, the sailboat 10 is fitted with a reversible camber wingsail 110. This disclosure is not limited to particular types of sailing vessels but can encompass any type of sailboat that is capable of being propelled by one or more wingsails.

The wingsail 110 is broadly configured to enable the sailboat 10 to sail upwind by tacking into port wind PW and starboard wind SW in alternating fashion. The wingsail 110 of the present disclosure is capable of forming first and second high lift airfoil shapes of opposite cambers. The wingsail 110 tacks by reversing the camber of the wingsail and alternating between the two high lift, low drag airfoil shapes. As will be explained in further detail below, the wingsail 110 employs an adjustable internal framework of spars and rotatable ribs to selectively configure a sailcloth to define the first and second high lift, low drag airfoil shapes.

FIG. 1 shows the wingsail 110 configured as a port wind high lift airfoil having a first camber. In this configuration, the starboard side of the wingsail 110 forms the aerodynamic upper surface of a high lift airfoil and the port side of the wingsail forms the aerodynamic lower surface of the high lift airfoil. Sailing into the port wind PW with the wingsail 110 configured as a port wind high lift airfoil as shown in FIG. 1 creates lift L in a forward-starboard direction. The forward component of lift L exceeds the aft component of drag D on the wingsail 110 to create a net force NF propelling the sailboat 10 forward.

FIG. 2 shows the wingsail 110 configured as a starboard wind high lift airfoil having a second camber opposite the first camber. In this configuration, the port side of the wingsail 110 forms the aerodynamic upper surface of a high lift airfoil and the starboard side of the wingsail forms the aerodynamic lower surface of the high lift airfoil. Sailing into the starboard wind SW with the wingsail 110 configured as a starboard wind high lift airfoil as shown in FIG. 2 creates lift L in a forward-port direction. The forward component of lift L exceeds the aft component of drag D on the wingsail 110 to create a net force NF propelling the sailboat 10 forward.

Figure 3:
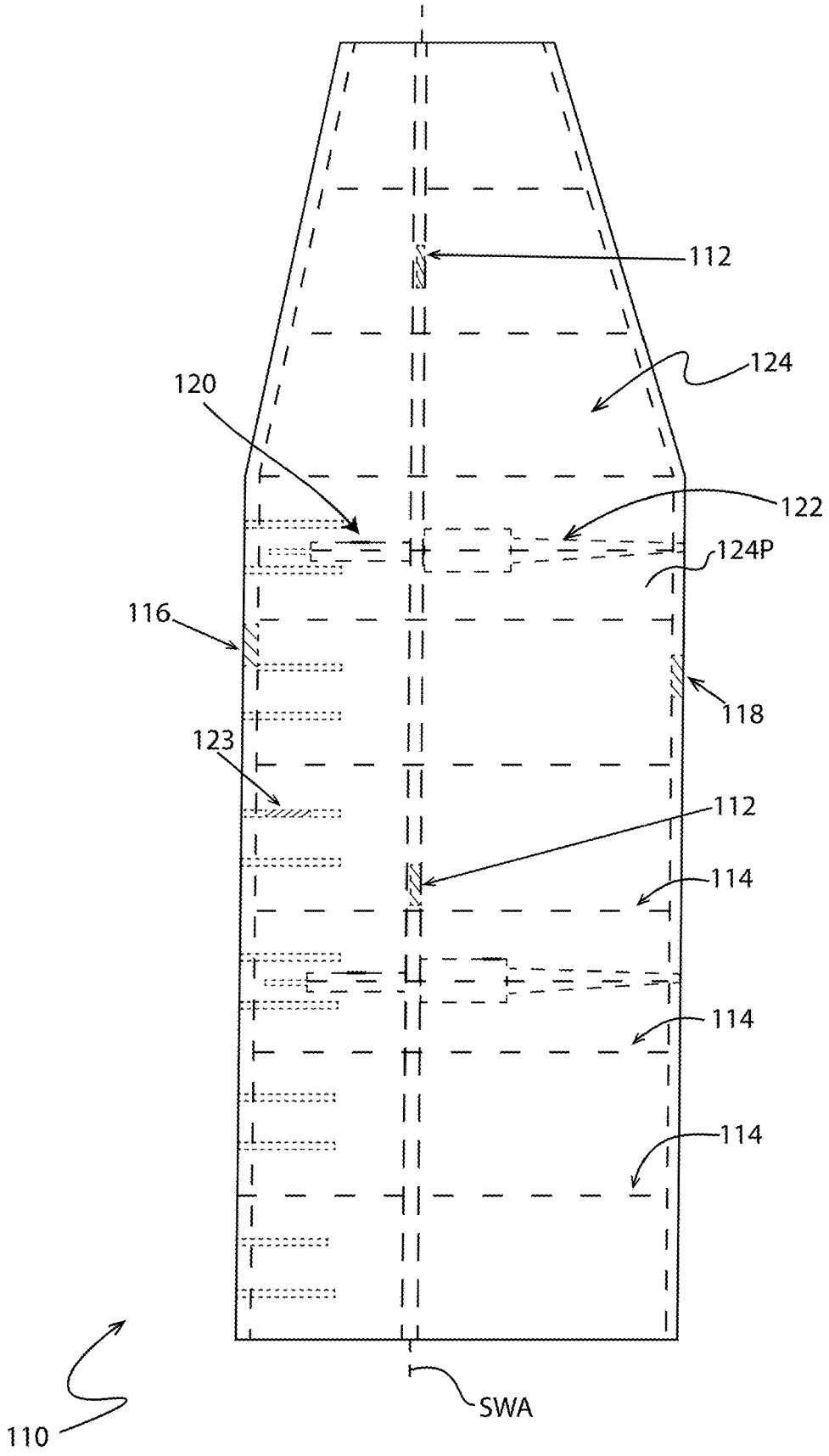
FIG. 3 is an illustrated elevation view of an exemplary embodiment of a main wingsail.
Figure 4:
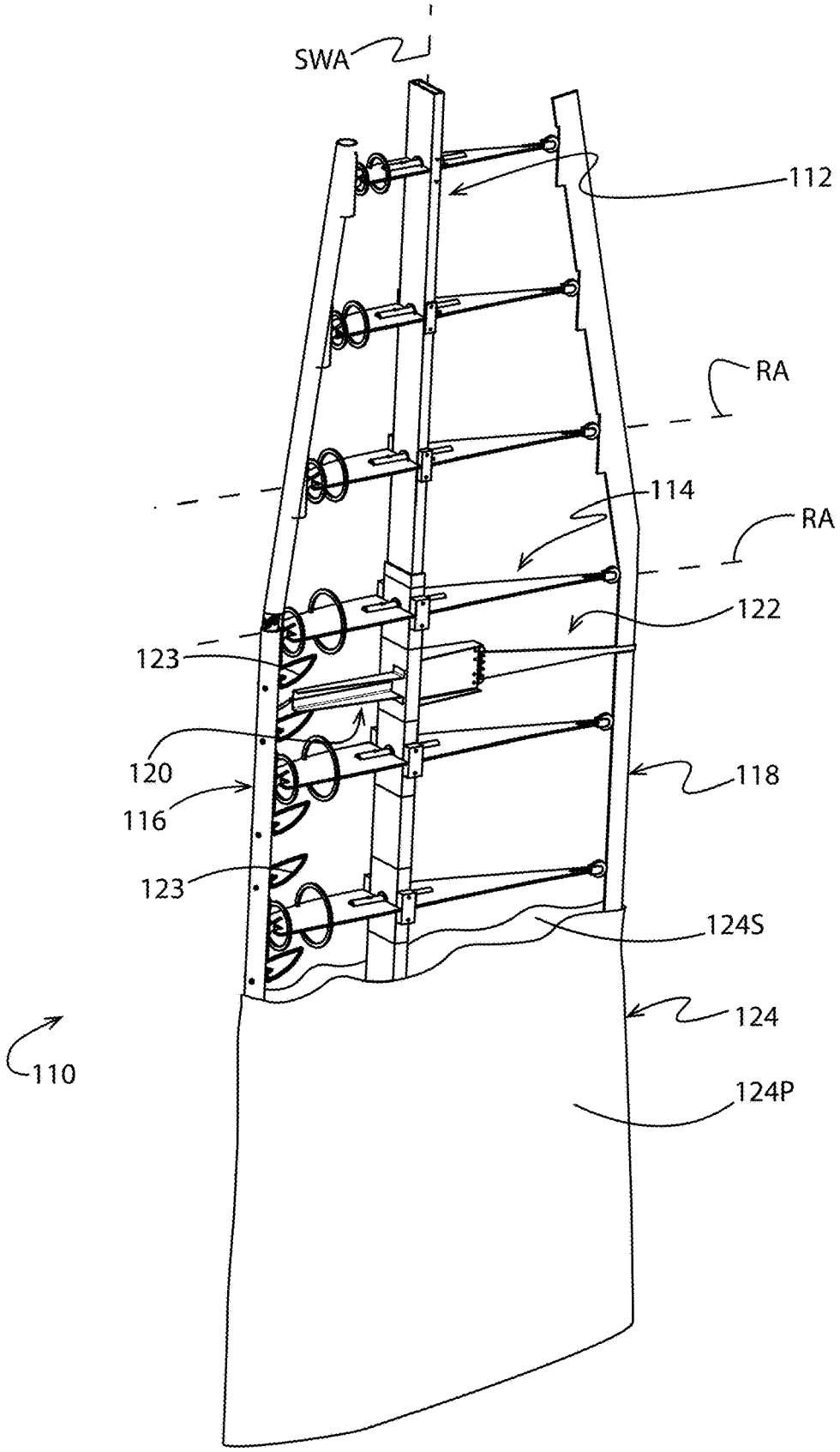
FIG. 4 is a cut-away illustrated perspective view of an exemplary embodiment of a main wingsail.
Figure 5:
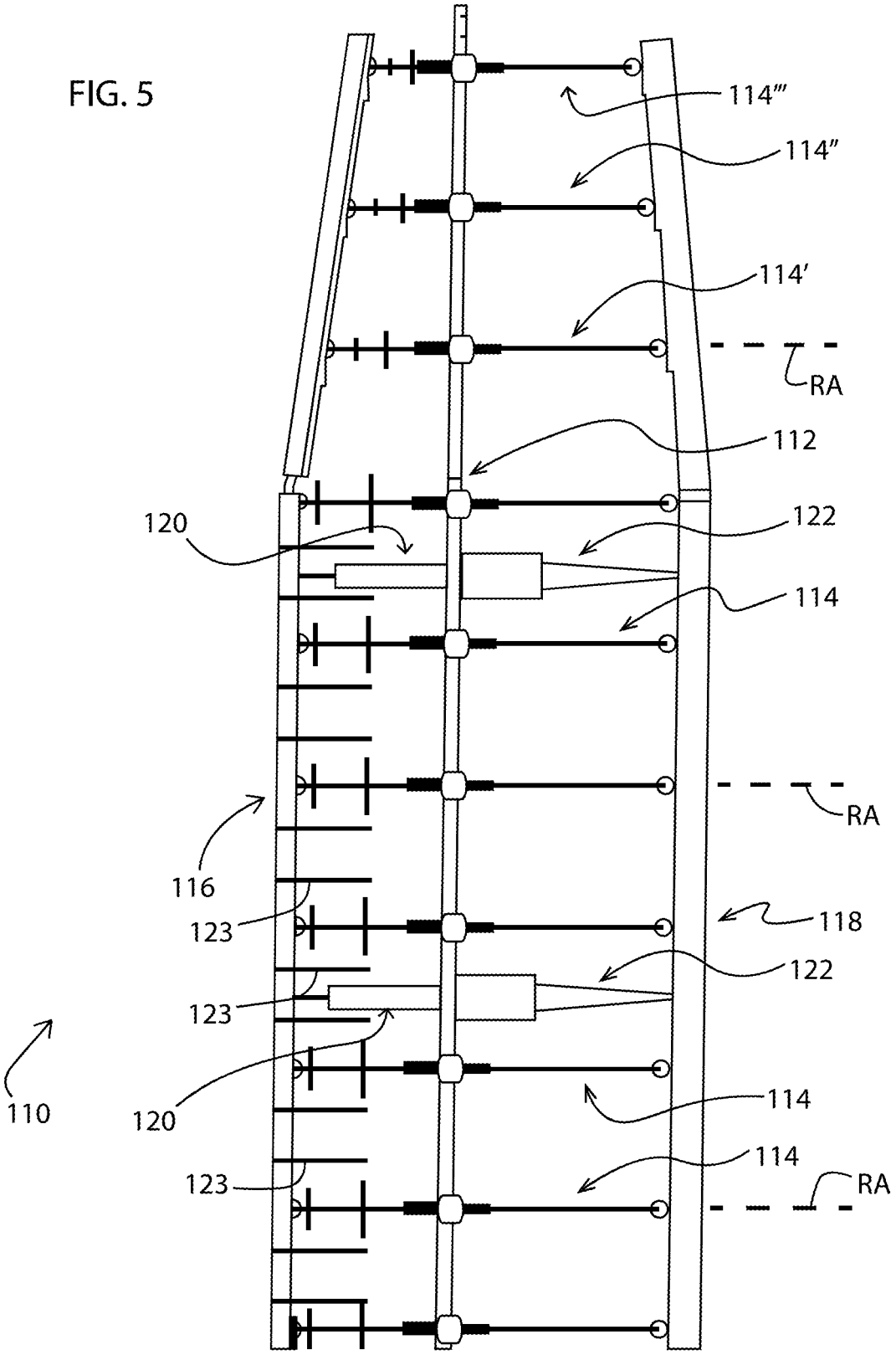
FIG. 5 is an elevation view of the internal structure of an exemplary embodiment of a main wingsail.

Referring to FIGS. 3-5, in the illustrated embodiment, the wingsail 110 comprises a main spar 112 extending along a spanwise axis SWA of the wingsail and a plurality of rotatable rib units 114 supported on the main spar at spaced apart locations along the spanwise axis. As will be explained in further detail below, each rib unit 114 is configured to rotate with respect to the main spar 112 about a respective axis of rotation RA through a range of motion between a port wind position to a starboard wind position. When the rib units 114 rotate to the port wind positions, they configure the wingsail 110 as a port wind high lift airfoil (FIG. 1); and when the rib units rotate to the starboard wind positions, they configure the wingsail 110 as a starboard wind high lift airfoil (FIG. 2). In the illustrated embodiment, the range of motion of each rib unit 114 about the respective axis of rotation RA also includes a neutral position between the port wind position and the starboard wind position. In the neutral positions, the rib units 114 configure the wingsail 110 as a symmetrical airfoil so that no lift is created by airflow across the wingsail when the angle of attack is zero. The neutral position enables the sailboat 10 to be moored without lowering or removing the wingsail 110.

The illustrated wingsail 110 further comprises a leading edge spar 116 for defining the leading edge of the airfoil and a trailing edge spar 118 for defining the trailing edge of the airfoil. As will be explained in further detail below, leading edge camber linkages 120 and trailing edge camber linkages 122 constrain the leading edge spar 116 and the trailing edge spar 118, respectively, in relationship to the main spar 112 so that the leading edge spar and the trailing edge spar will move in a defined range of motion as the rib units 114 rotate to change the camber of the airfoil. In the illustrated embodiment, a set of riblets 123 are mounted on the leading edge spar 116 to aid the rib units 114 in forming the leading portion of the airfoil. The riblets 123 provide precise contour shaping of the sailcloth to establish the critical leading edge portion of the wingsail. As will be explained in further detail below, the riblets 123 are fixed to the leading edge spar 116 for movement with the leading edge spar.

A sailcloth 124 is wrapped around the spars 112, 116, 118, rib units 114, and riblets 123, such that these components are received between a port side sheet portion 124P and a starboard side sheet portion 124S of the sailcloth. As will be explained in further detail below, when the rib units 114 rotate to the port wind positions, the assembly inside the sailcloth 124 adjusts the sailcloth to form the port wind high lift airfoil depicted in FIG. 1. Specifically, the internal assembly forms the port side sheet portion 124P to define the aerodynamic lower surface of the port wind high lift airfoil and forms the starboard side sheet portion 124S to define an aerodynamic upper surface of the port wind high lift airfoil. Conversely, when the rib units 114 rotate to the starboard wind positions, the assembly inside the sailcloth 124 adjusts the sailcloth to form the starboard wind high lift airfoil depicted in FIG. 2. In this case, the assembly forms the starboard side sheet portion 124S to define the aerodynamic lower surface of the starboard wind high lift airfoil and forms the port side sheet portion 124P to define an aerodynamic upper surface of the starboard wind high lift airfoil. The sailcloth 124 may contain battens between each rib unit location to help define the high lift airfoil.

Figure 6:
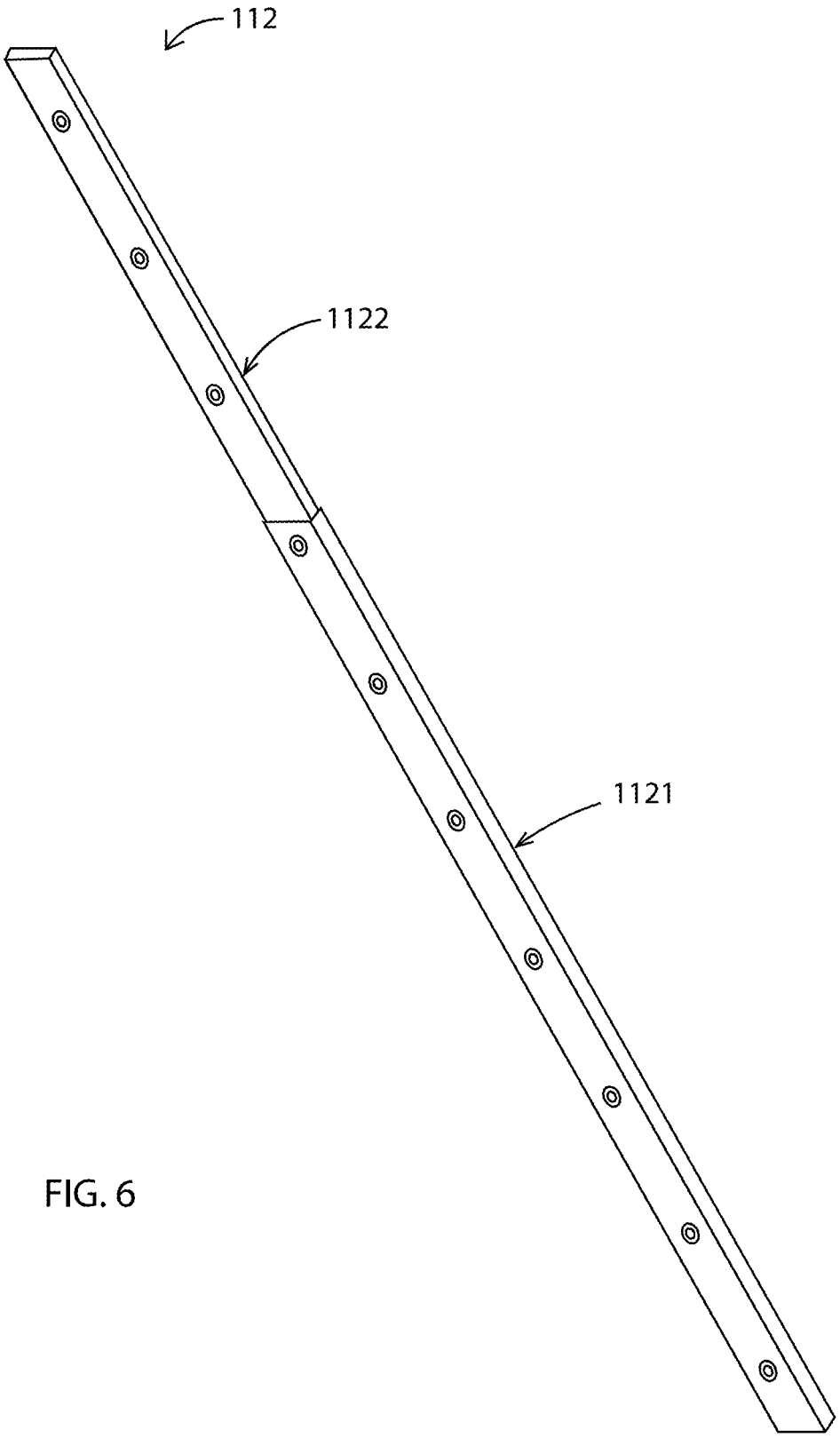
FIG. 6 is a perspective view of an exemplary embodiment of a main spar.

Referring to FIG. 6, in one or more embodiments the main spar 112 comprises a rectangular tube extending along the spanwise axis SWA of the wingsail 110. In the illustrated embodiment, the main spar 112 is formed from a lower spar tube 1121 and an upper spar tube 1122 of slightly smaller dimensions. For example, in one non-limiting embodiment, the upper spar tube is a 1.5"×4" aluminum tube and the lower spar is a 2"×6" aluminum tube. A plurality of support bearings 133 are mounted on the main spar 112 at spaced apart locations along the spanwise axis SWA for rotatably supporting the rib units 114.

Figure 7:
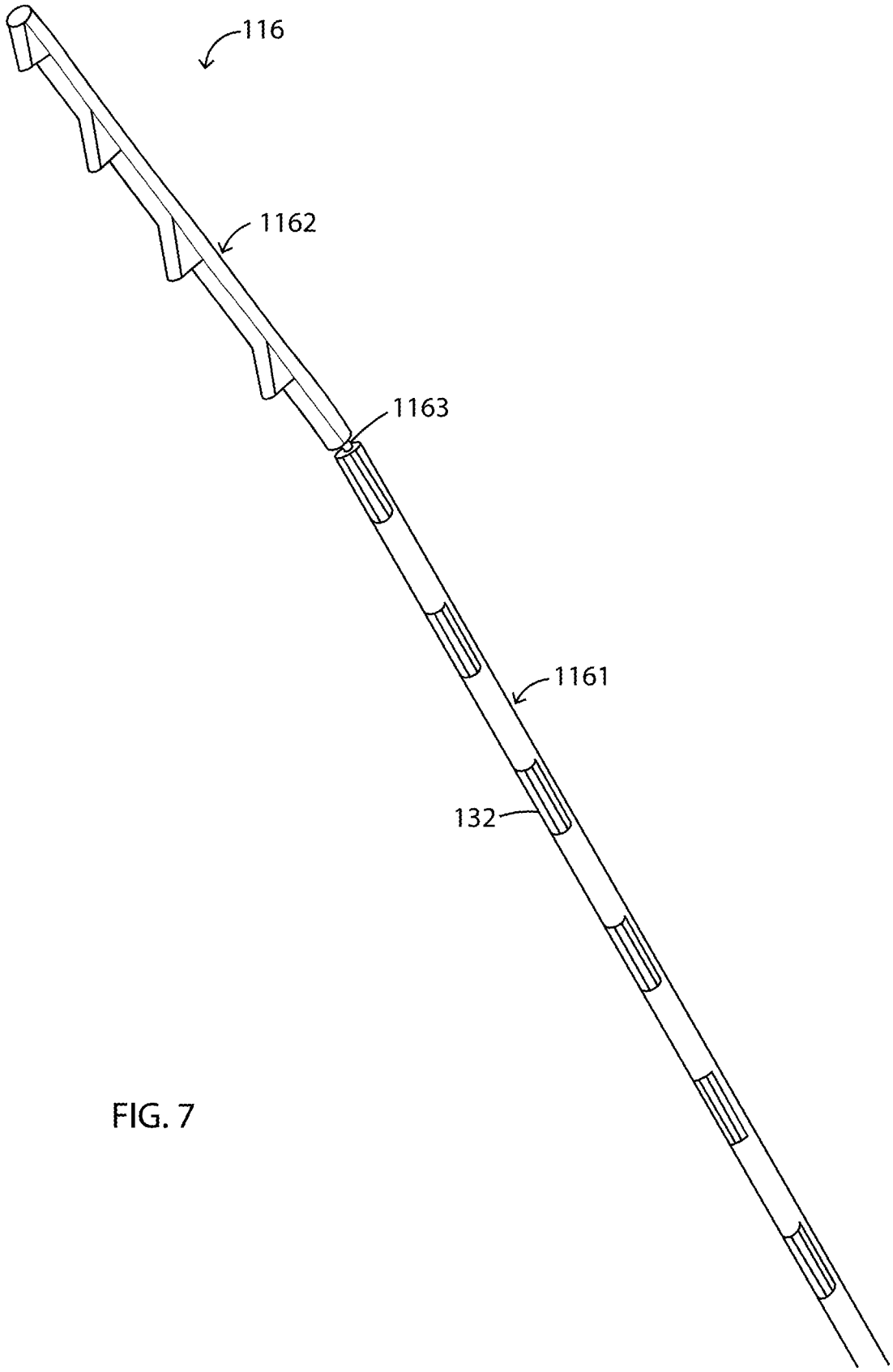
FIG. 7 is a perspective view an exemplary embodiment of a leading edge spar.

Referring to FIG. 7, the leading edge spar 116 is formed from one or more cylindrical tubes. In the illustrated embodiment, the leading edge spar 116 comprises a lower tube 1161 and an upper tube 1162 connected by a U-joint 1163. The use of two spar tubes 1161, 1162 in the illustrated embodiment provides for the non-limiting wingsail shape depicted in FIG. 3, where the lower segment (defined, in part, by the lower leading edge spar tube 1161) and the upper segment (defined, in part, by the upper leading edge spar tube 1162) have a uniform cross section shape. The upper segment has a chordwise dimension that tapers toward the top end of the wingsail 110. It will be understood that other spar configurations may be selected to form wingsails of other shapes without departing from the scope of the disclosure.

Figure 8:
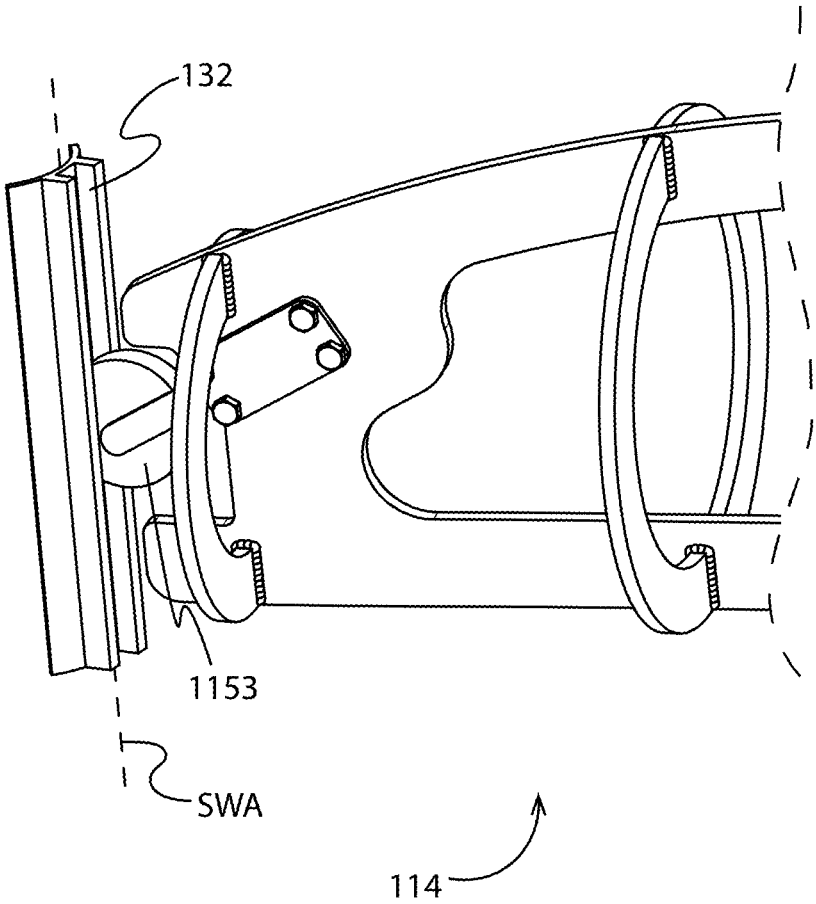
FIG. 8 is an enlarged fragmentary perspective of a leading rib engaged with the leading edge spar.

The leading edge spar 116 further comprises one or more tracks 132 extending spanwise on the spar tubes 1161, 1162. The track(s) 132 are configured to guide a wheel associated with each rib unit 114 as the rib unit rotates, as will be described in further detail below. An enlarged perspective view of the guide wheel engaged with a track on the lower spar tube 1161 is shown in FIG. 8. Various ways of positioning the track(s) on the spar tubes 1161, 1162 can be used without departing from the scope of the disclosure. For example, in an embodiment, the upper spar tube 1162 comprises a plurality of discontinuous tracks positioned on the tube such that the tracks are parallel to the spanwise axis SWA. The positioning of the tracks 132 on the upper spar tube 1162 may be achieved by placing angled supports under each track 132 such that the tracks are running parallel to the spanwise axis SWA The lower spar tube 1161 comprises a plurality of discontinuous track members 132 (e.g., one for each rib unit 114) mounted on the tube at spaced apart locations along the spanwise axis SWA.

Figure 9:
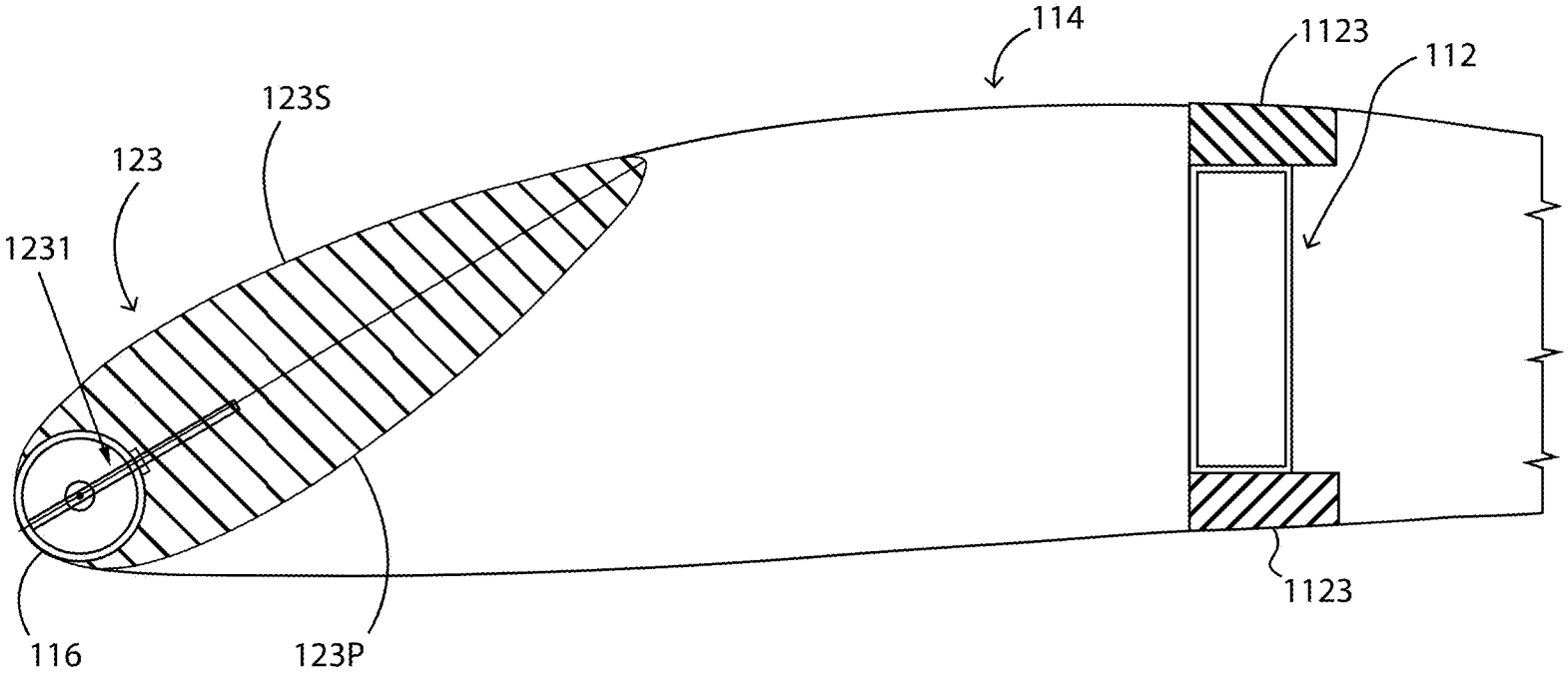
FIG. 9 is an illustrated plan view of an exemplary embodiment of a forward portion of a main wingsail.

Referring to FIG. 9, each riblet 123 is fixedly mounted on the leading edge spar 116 to extend aft from the leading edge spar inside the sailcloth 124. In the illustrated embodiment, each riblet 123 is secured to the respective spar tube 1161, 1162 by a screw 1231. As shown, each riblet 123 has a symmetrical airfoil shape. Each riblet 123 thus has a convex port edge 123P and convex starboard edge 123S. During use when the wingsail 110 is in the port wind airfoil configuration, as shown here, the starboard edge 123S of each riblet supports the starboard side sheet portion 124S of the sailcloth 124 to help form the aerodynamic upper surface of the airfoil. Except for immediately adjacent the leading edge spar 116, the port edge 123P of each riblet 123 does not contact the port side sheet portion 124P of the sail cloth in the port wind airfoil configuration. Conversely, when the wingsail 110 is in the starboard wind configuration (not shown), the port edge 123P of each riblet 123 will support the port side sheet portion 124P of the sailcloth 124 to help form the aerodynamic upper surface of the airfoil on the port side of the wingsail 110. Except for immediately adjacent the leading edge spar 116, the starboard edge 123S of each riblet 123 does not contact the starboard side sheet portion 124S of the sail cloth 124 in the starboard wind airfoil configuration.

It can be seen from FIGS. 3-5, for example, that the riblets 123 are located at spaced apart locations between the rotatable rib units 114. Referring again to FIG. 9, in certain embodiments, in the spanwise regions between the rotatable rib units 114, the main spar 112 can also be fitted with airfoil-contoured fillers 1123 on opposite sides. Such fillers 1123 help form the airfoil shape of the sailcloth 124 at the chordwise position of the main spar 112, more specifically, the fillers 1123 help to maintain the shape of the sailcloth over the aerodynamic upper profile edge 1142 in both the port wind position and starboard wind position as will be described in further detail below. In other embodiments, the fillers 1123 can be omitted from the spanwise regions between the rotatable rib units 114.

Figure 10:
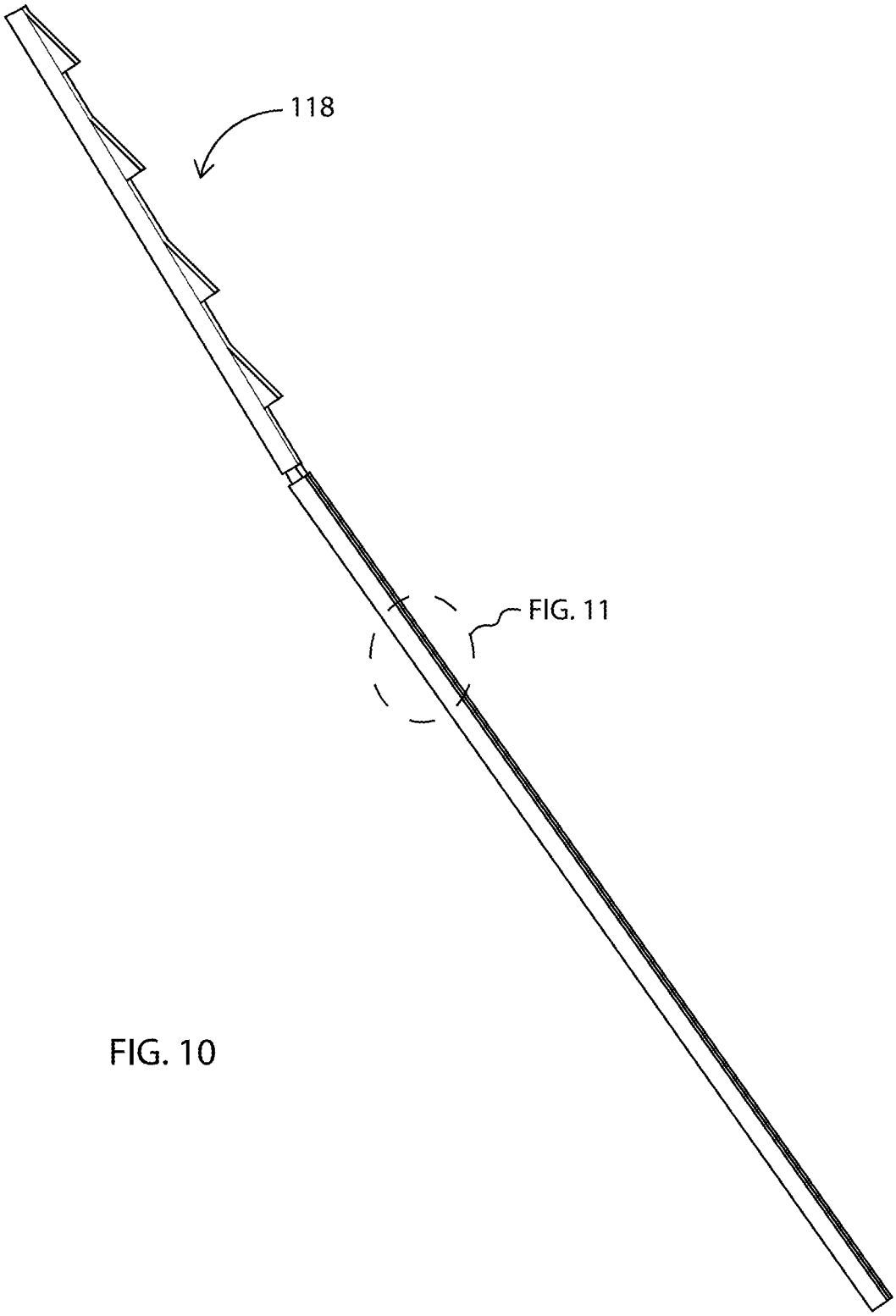
FIG. 10 is a perspective view of an exemplary embodiment of a trailing edge spar.
Figure 11:
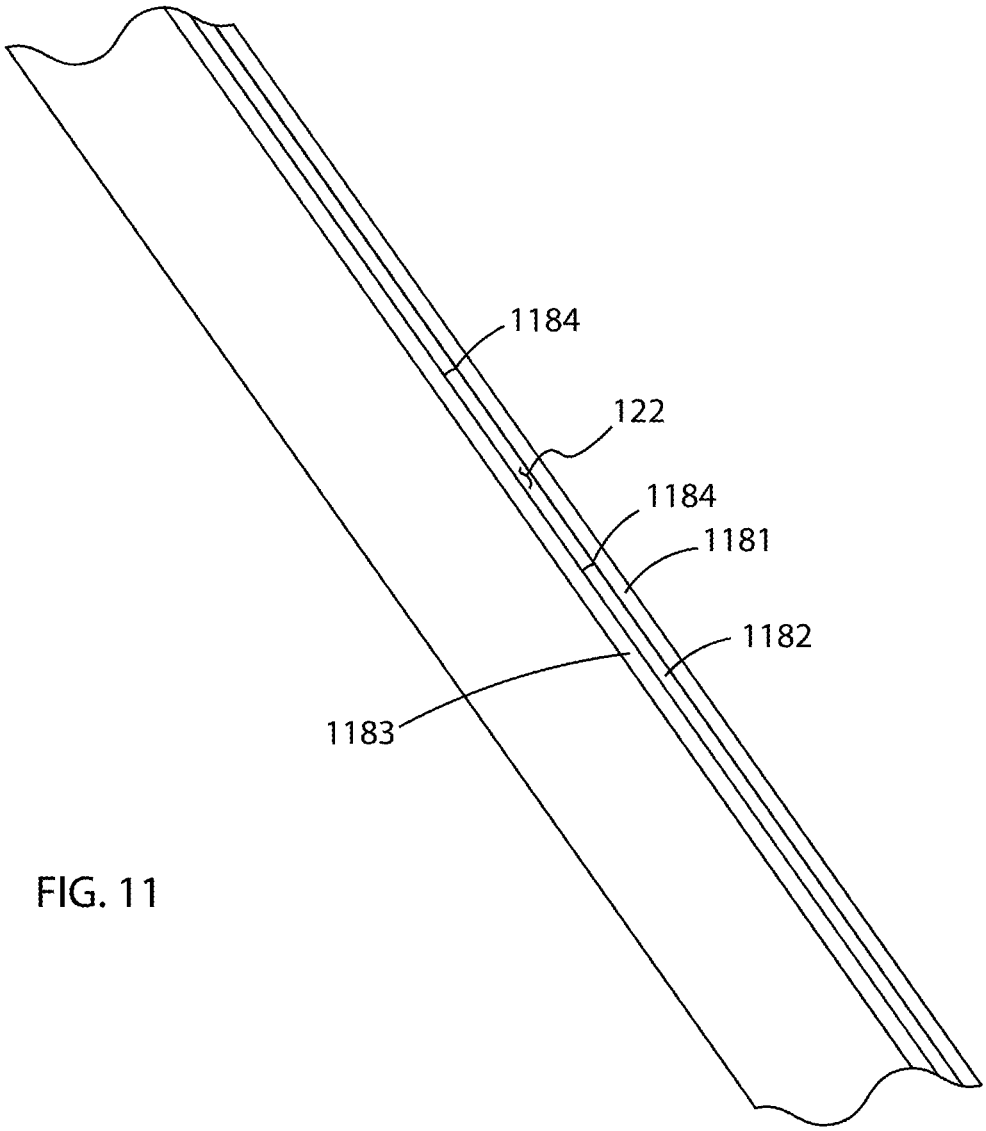
FIG. 11 is an enlarged fragmentary perspective of the trailing edge spar of FIG. 10.

Referring to FIGS. 10 and 11, the trailing edge spar 118 comprises a forward edge margin and an aft edge margin. The forward edge margin of the trailing edge spar 118 forms a roller guide extending along the spanwise axis. As will be explained in further detail below, the roller guide is configured to guide a wheel associated with each rib unit as the rib unit rotates. In the illustrated embodiment, a lower section of the trailing edge spar 118 (corresponding height wise with the lower leading edge spar tube 1161) is formed from three plate layers, specifically, a port side plate layer 1181, a middle plate layer 1182, and a starboard side plate layer 1183. The front edge margin of the middle plate layer 1182 is proud of the front edge margin of the side plate layers 1181, 1183 to form the roller guide along the lower section of the trailing edge spar 118. In addition, the middle plate layer 1183 defines a plurality of slots 1184 at spaced apart locations along the spanwise axis SWA. As will be explained in further detail below, the slots 1184 are configured to slidably receive portions of the trailing edge camber linkage 122.

Figure 12:
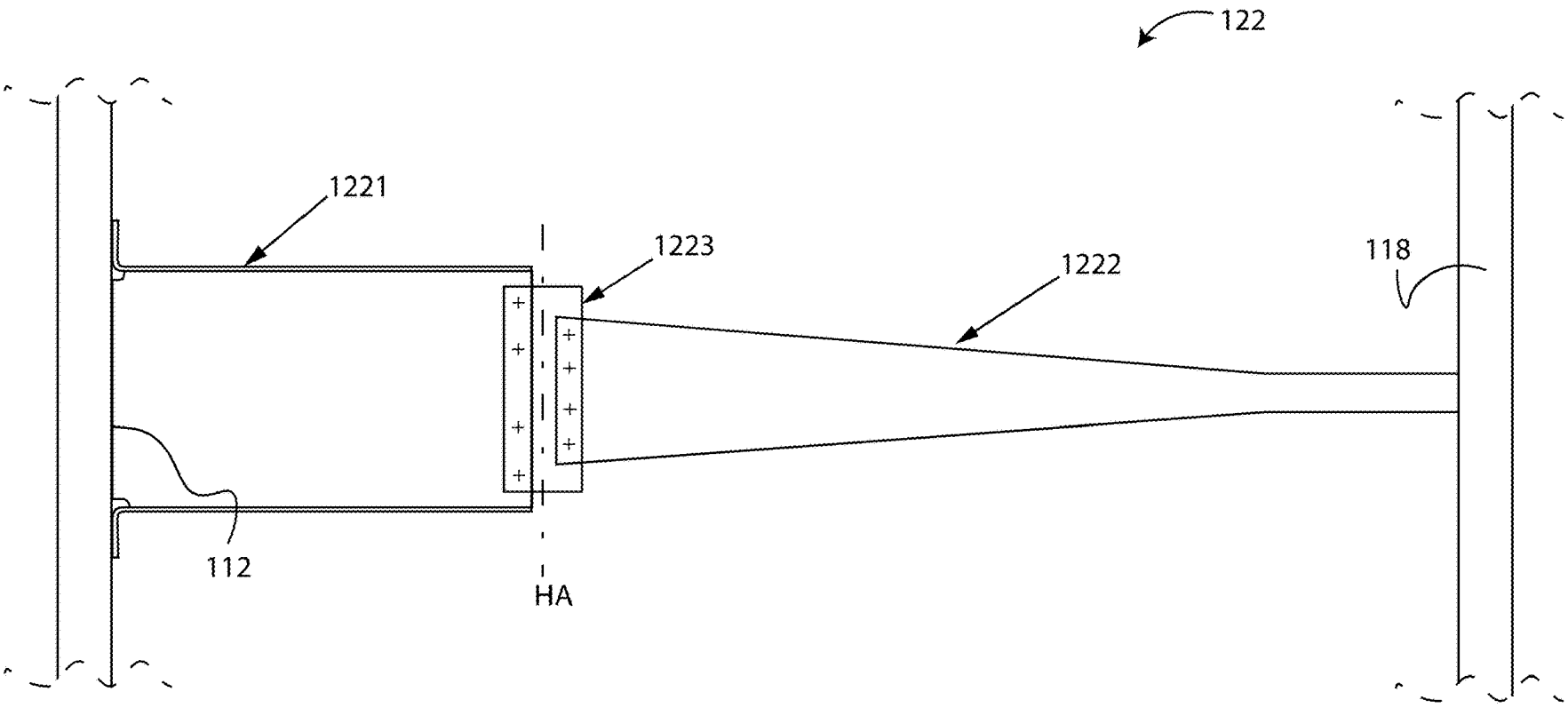
FIG. 12 is an illustrated elevation view of an exemplary embodiment of a trailing edge camber linkage.

Referring to FIG. 12 each trailing edge camber linkage 122 comprises a trailing edge camber bracket 1221, a trailing edge camber arm 1222, and a hinge 1223 pivotably connecting the trailing edge camber arm to the trailing edge camber bracket. Each trailing edge camber bracket 1221 is mounted on the aft side of the main spar 112 and extends in an aft direction. The hinge 1223 is mounted on the aft end portion of the respective trailing edge camber bracket 1221. The trailing edge camber arm 1222 has a forward end portion that is fastened to the hinge 1223. The hinge 1223 permits the trailing edge camber arm to rotate with respect to the trailing edge camber bracket 1221 about a hinge axis HA. The aft end portion of the trailing edge camber arm 1222 is configured to be slidably received in one of the slots 1184 in the trailing edge spar 118. Thus, the trailing edge camber linkage 122 supports the trailing edge spar 118 on the main spar 112 so that the trailing edge spar can rotate with respect to the main spar about the hinge axis HA and can also move chordwise in relation to the main spar in a limited range of motion as trailing edge camber arm 1222 slides in the respective slot 1184. As will be explained in further detail below, the rotational degree of freedom about the hinge axis HA permits the rotatable rib units 114 to adjust the position of the trailing edge spar 118 for forming the trailing edge of the airfoil in each of the port wind high lift airfoil configuration, the neutral position, and the starboard wind high lift airfoil configuration. The chordwise degree of freedom for the trailing edge spar 118 enables the wingsail 110 to selective tension and relax the sailcloth 124 to permit adjustment of the airfoil configuration.

Figure 13:
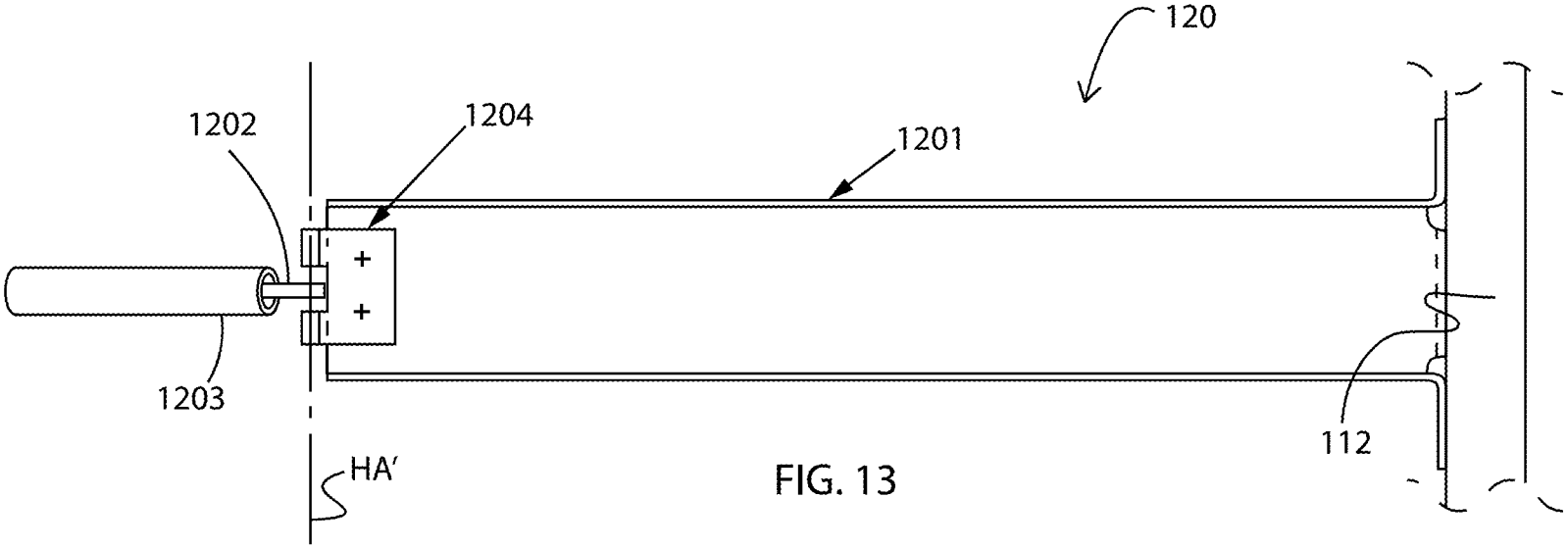
FIG. 13 is an illustrated elevation view of an exemplary embodiment of a leading edge camber linkage.
Figure 14:
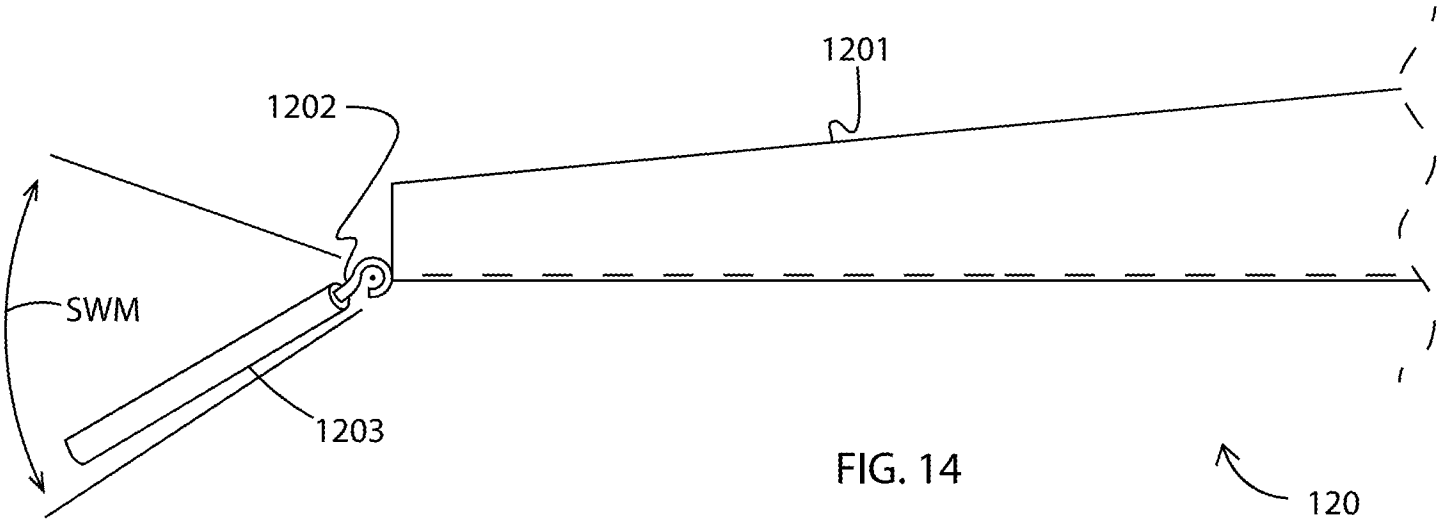
FIG. 14 is an illustrated plan view of the leading edge camber linkage of FIG. 13.

Referring to FIGS. 13-14, the leading edge camber linkage 120 comprises a leading edge camber bracket 1201, a leading edge camber arm rod 1202, a leading edge camber arm slide tube 1203 slidably supported on the leading edge camber arm rod, and a hinge 1204 pivotably connecting the leading edge camber arm rod to the leading edge camber bracket. The leading edge camber arm rod 1202 and the leading edge camber arm slide tube 1203 collectively form a leading edge camber arm of the leading edge camber linkage 120. Each leading edge camber bracket 1201 is mounted on the forward side of the main spar 112 and extends in the forward direction from the main spar. The hinge 1204 is mounted on the forward end portion of the respective leading edge camber bracket 1201. The leading edge camber arm rod 1202 has an aft end portion that is rotatably connected to the hinge 1204. The hinge 1204 permits the leading edge camber arm to rotate with respect to the leading edge camber bracket 1201 about a hinge axis HA'. The hinge 1204 also permits the leading edge camber arm to pivot up and down in a limited range of spanwise motion, shown schematically at SWM in FIG. 14. The leading end of the slide tube 1203 is connected to the leading edge spar 116. Thus, the leading edge camber linkage 120 supports the leading edge spar 116 on the main spar 112 so that the leading edge spar can rotate with respect to the main spar about the hinge axis HA', can move spanwise in relation to the main spar in a limited range of motion corresponding to the spanwise pivot range SWM depicted in FIG. 14, and can move chordwise in relation to the main spar in a limited range motion as the slide tube slides with respect to the camber arm rod 1202. As will be explained in further detail below, the rotational degree of freedom about the hinge axis HA' permits the rotatable rib units to adjust the position of the leading edge spar for forming the leading edge of the airfoil in each of the port wind airfoil configuration, the neutral airfoil configuration, and the starboard wind airfoil configuration. The spanwise and chordwise degrees of freedom for the leading edge spar 112 enable the wingsail 110 to selective tension and relax the sailcloth 124 to permit adjustment of the airfoil configuration.

Figure 15:
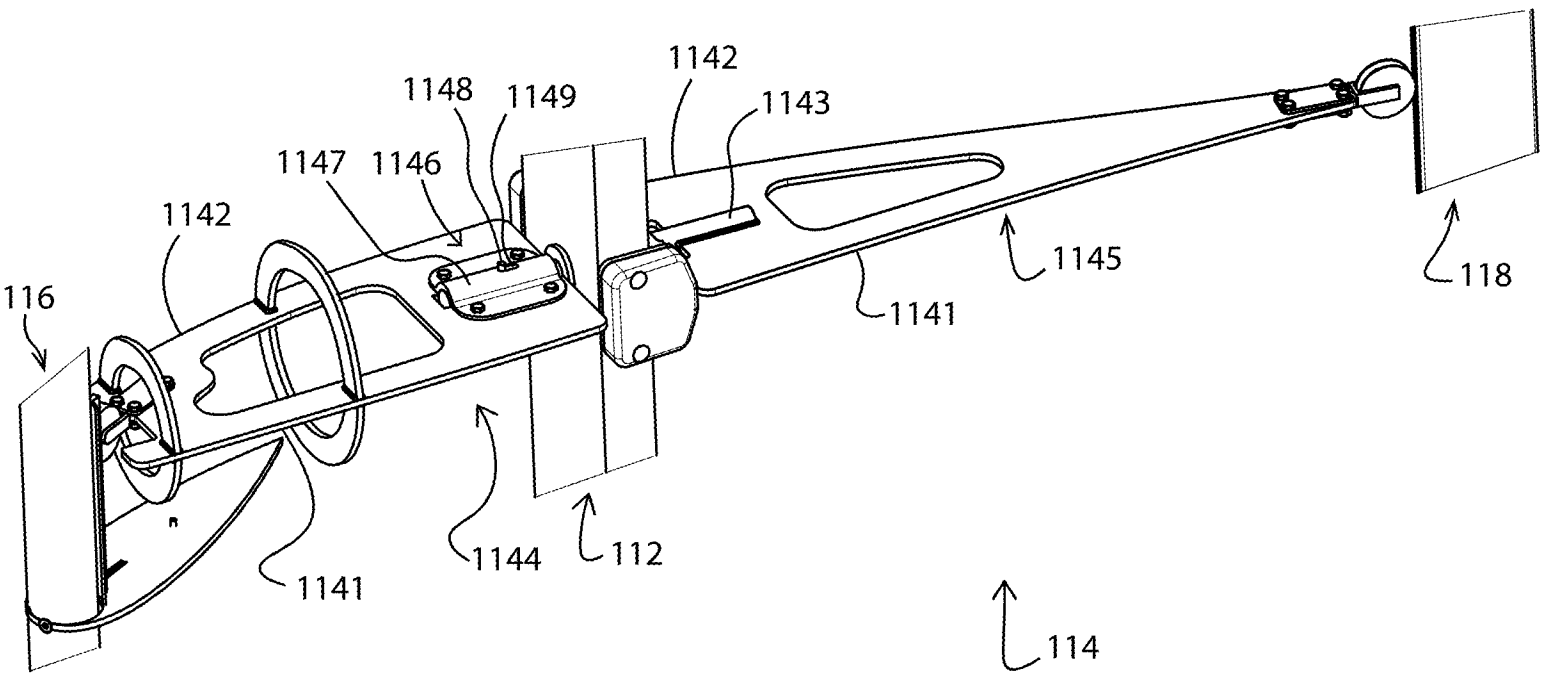
FIG. 15 is an enlarged fragmentary perspective of an exemplary embodiment of a rib unit of the main wingsail.
Figure 16:
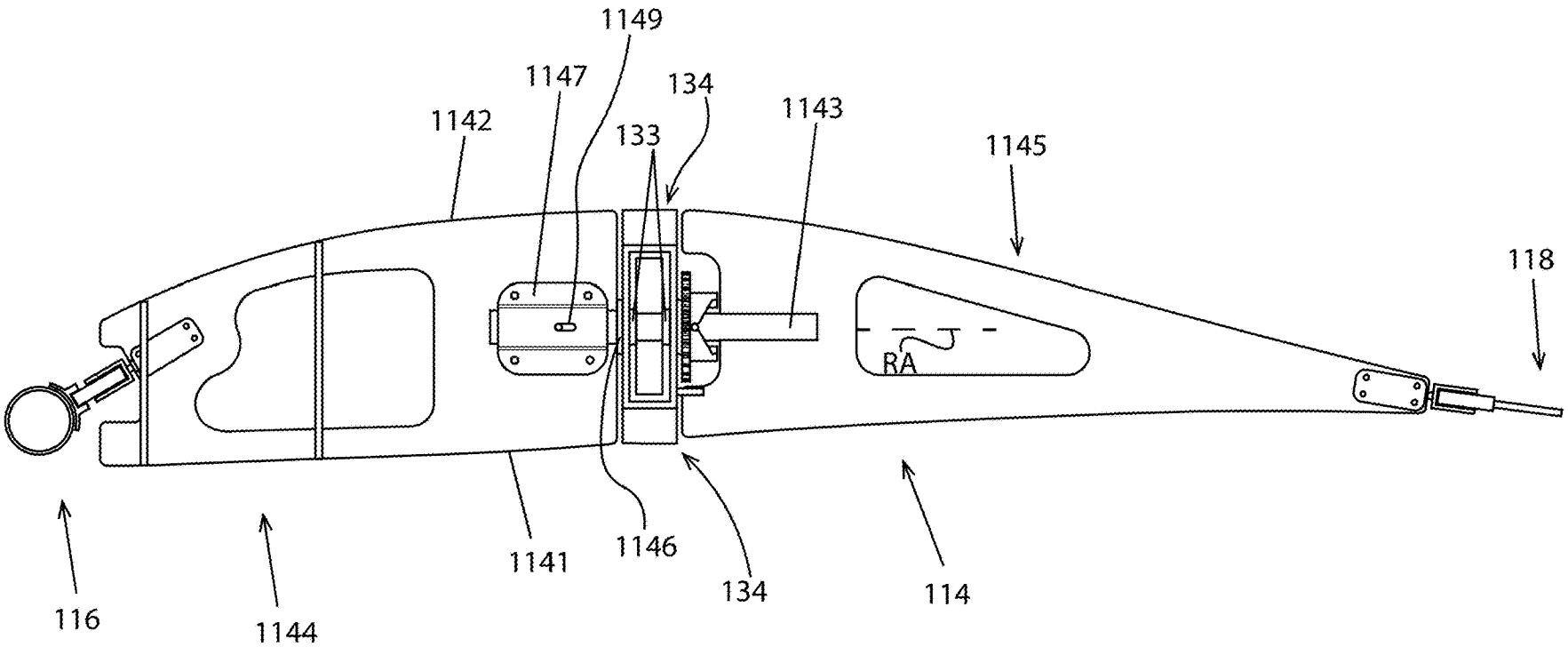
FIG. 16 is a plan view of an exemplary embodiment of a rib unit of the main wingsail.
Figure 17:
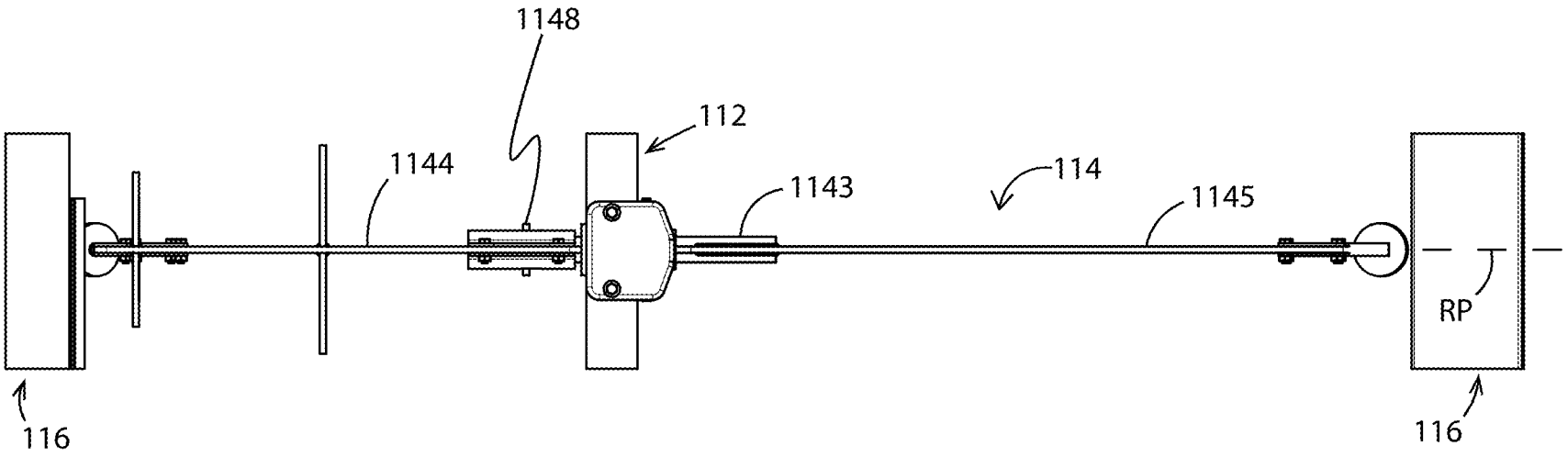
FIG. 17 is an elevation view of an exemplary embodiment of a rib unit of the main wingsail.

Referring to FIGS. 15-17, an exemplary embodiment of a rotatable rib unit 114 will now be described. In general, each rib unit 114 extends substantially in a rib plane RP (FIG. 17) and is configured to define a high lift airfoil profile in the respective rib plane. The high lift airfoil in the rib plane RP includes an aerodynamic lower profile edge 1141 and an aerodynamic upper profile edge 1142. The axis of rotation RA of each rotatable rib unit 114 lies on the respective rib plane RP. When the rotatable rib units 114 are rotated to the port wind positions, each rib unit is oriented so the respective aerodynamic lower profile edge 1141 is on the port side of the wingsail 110 and the respective aerodynamic upper profile edge 1142 is on the starboard side of the wingsail. When the rotatable rib units 114 are rotated to the starboard wind positions, each rib unit 114 is oriented so the respective aerodynamic lower profile edge 1141 is on the starboard side of the wingsail 110 and the respective aerodynamic upper profile edge 1142 is on the port side of the wingsail. In the neutral airfoil position, the rib plane RP extends generally spanwise.

Each rib unit 114 comprises a drive shaft 1143 rotatably connected to the main spar 112 at one of the support bearings 133. A leading rib 1144 is mounted on the drive shaft 1143 forward of the main spar 112 for rotation with the drive shaft, and a trailing rib 1145 is mounted on the drive shaft aft of the main spar for rotation with the drive shaft. The leading rib 1144 defines leading segments of the aerodynamic lower profile edge 1141 and aerodynamic upper profile edge 1142 of the respective rib unit 114, and the trailing rib 1145 defines trailing segments of the aerodynamic lower profile edge and aerodynamic upper profile edge of the respective rib unit. Suitably, the leading segments of the aerodynamic lower profile edges 1141 can be slightly convex and the trailing segments of the aerodynamic lower profile edges can be concave. Both segments of the aerodynamic upper profile edge 1142 are predominantly convex in the illustrated embodiment. The rib unit 114 may include features such as truss structures that minimizes weight while providing sufficient structural rigidity.

In one or more embodiments, each rib unit 114 comprises a thrust bushing 1146 configured so that the leading rib 1144 and trailing rib 1145 are movable in relation to one another along the axis of rotation RA in a limited range of axial motion to adjust the rib unit between a retracted configuration and an extended configuration. In the illustrated embodiment, the thrust bushing 1146 is on the leading rib 1144, and the trailing rib 1145 is fixedly attached (e.g., welded) to the drive shaft 1143. More specifically, the illustrated rib unit 114 comprises a slotted collar 1147 fastened to the leading rib 1144, and the forward end portion of the drive shaft 1143 is slidably received in the slotted collar. The forward end portion of the drive shaft 1143 comprises a pin 1148 and the slotted collar 1147 comprises a chordwise slot 1149 in which the pin is slidably received. The slot 1149 and pin 1148 allow for the drive shaft 1143 (and trailing rib 1145) to slide along the axis of rotation RA in relation to the leading rib 1144 in a limited range of motion.

Figure 18:
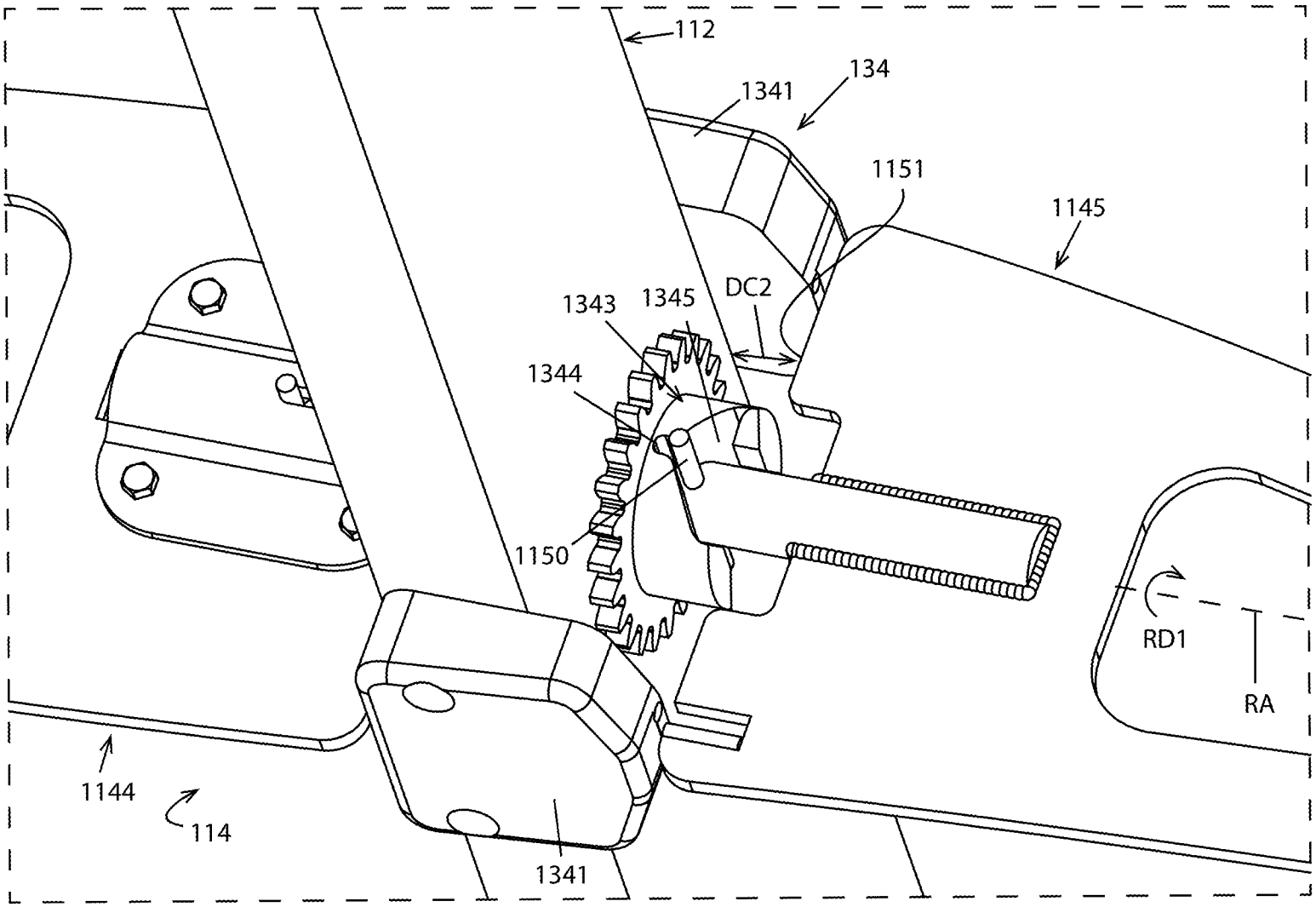
FIG. 18 is an enlarged perspective of an exemplary embodiment of a rotatable rib unit engaged with a stop in the RD1 (port) direction.

Referring to FIG. 18, the wingsail 110 comprises a cam mechanism 134 for each rib unit 114. Each cam mechanism 134 is broadly configured to control movement of the leading rib 1144 and trailing rib 1145 in relation to one another by cam action as the rib unit 114 rotates about the axis of rotation RA from the port wind position to the starboard wind position. In this way, the cam mechanism 134 is configured to adjust the rib unit 114 to the extended configuration in the port wind position and the starboard wind position to tension the sailcloth 124 and to adjust the rib unit to the retracted configuration at angular positions about the axis of rotation RA between the port wind position and the starboard wind position to relax the sailcloth.

Each cam mechanism 134 comprises a fixed cam 1341 mounted on the main spar 112 adjacent the respective rib unit 114. Each rib unit 114 comprises a follower surface 1151 configured for camming engagement with the respective fixed cam 1341 as the rib unit rotates about the axis of rotation RA between the port wind position and the starboard wind position. Each cam mechanism 134 further comprises a stop 1342 for the respective rib unit 114. The stop 1342 is configured to stop rotation of the respective rib unit 114 in a first rotational direction RD1 at the port wind position and to stop rotation of the respective rib unit in a second rotational direction RD2 at the starboard wind position. In an example, the stop 1342 comprises a stop pin 1346 extending from each fixed cam 1341, 1342. In an embodiment, the trailing rib 1145 has a clearance feature 1347 to clear the stop pin when the rib unit 114 rotates from the port wind position to the starboard wind position.

Each cam mechanism 134 further comprises a cam rotor 1343 for each rib unit 114. Each cam rotor 1343 is mounted on the main spar 112 for rotation with respect to the main spar about the axis of rotation RA for the respective rib unit 114. Each cam rotor 1343 comprises a detent feature 1344 and a cam surface 1345. The cam mechanism 134 for each rib unit 114 comprises a detent follower 1150 configured to releasably engage the detent feature 1344 of the respective cam rotor 1343 to link the rib unit 114 to the cam rotor for rotation with the cam rotor about the axis of rotation RA when the rib unit is in the retracted configuration (See FIG. 19). In the illustrated embodiment, each detent feature 1344 comprises a groove in the cam rotor 1343 and each detent follower 1150 comprises a pin mounted on the drive shaft 1143. The detent follower pin 1150 extends radially with respect to the axis of rotation RA.

Figure 19:
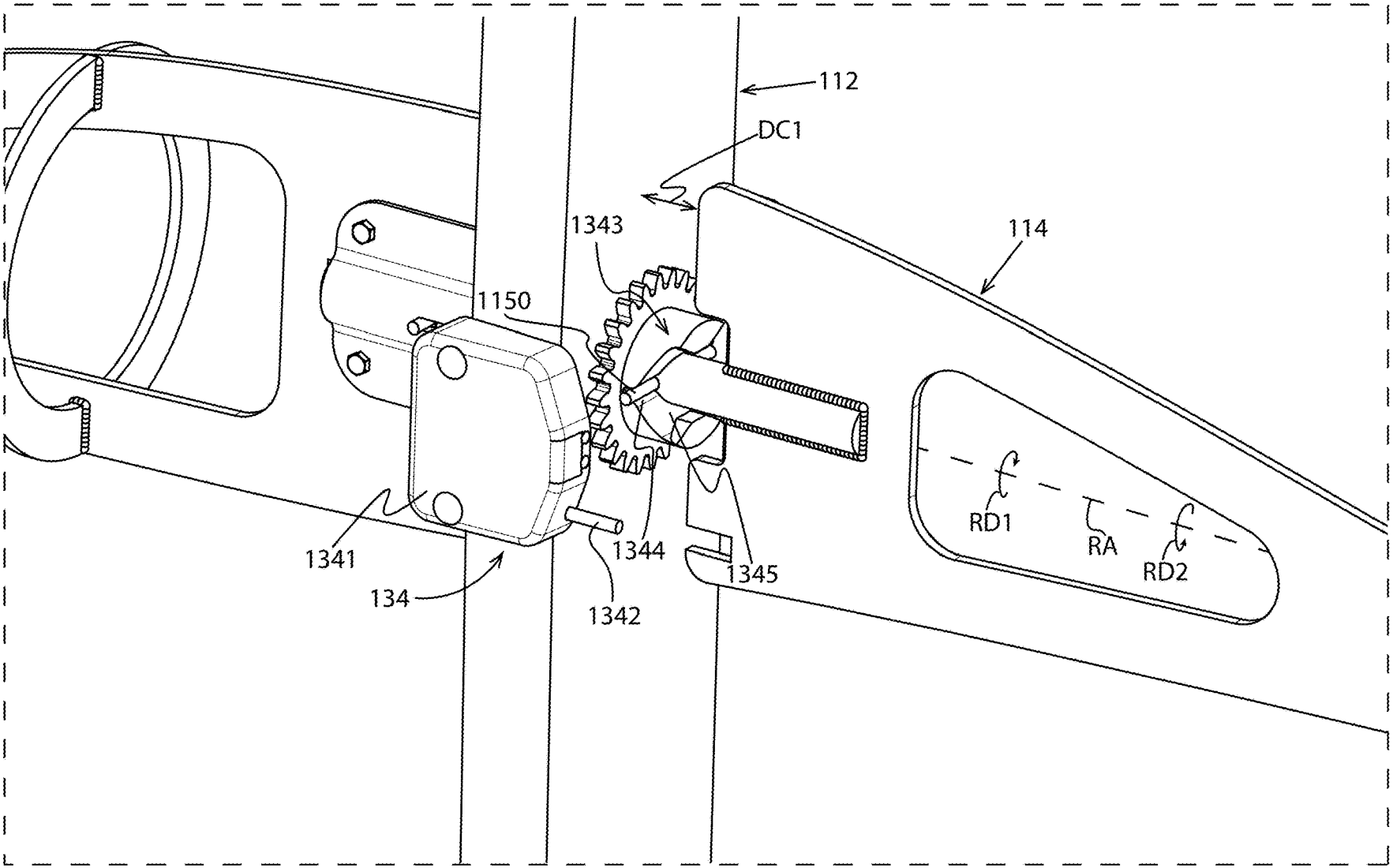
FIG. 19 is an enlarged perspective of an exemplary embodiment of a rotatable rib unit in the neutral position.

Referring to FIG. 19, whenever the rib unit 114 is at any rotational position between the port wind position and the starboard wind position, each cam mechanism 1343 is configured to retract the respective rib unit 114 to the retracted configuration where the detent follower 1150 engages the detent feature 1344 and thereby links the rib unit to the cam rotor 1343 for rotation with the cam rotor. As a point of reference, when the rib unit 114 is in the retracted configuration, the chordwise distance between the follower surface 1151 of the rib unit and the nearest surface of the main spar 112 is DC1, as shown in FIG. 19. From any rotational position between the port wind position and the starboard wind position, the cam rotor 1343 is rotatable in a first rotational direction RD1 and a second rotational direction RD2. The action of the cam mechanism 134 in each rotational direction RD1, RD2 will be explained in the following two paragraphs.

Figure 20:
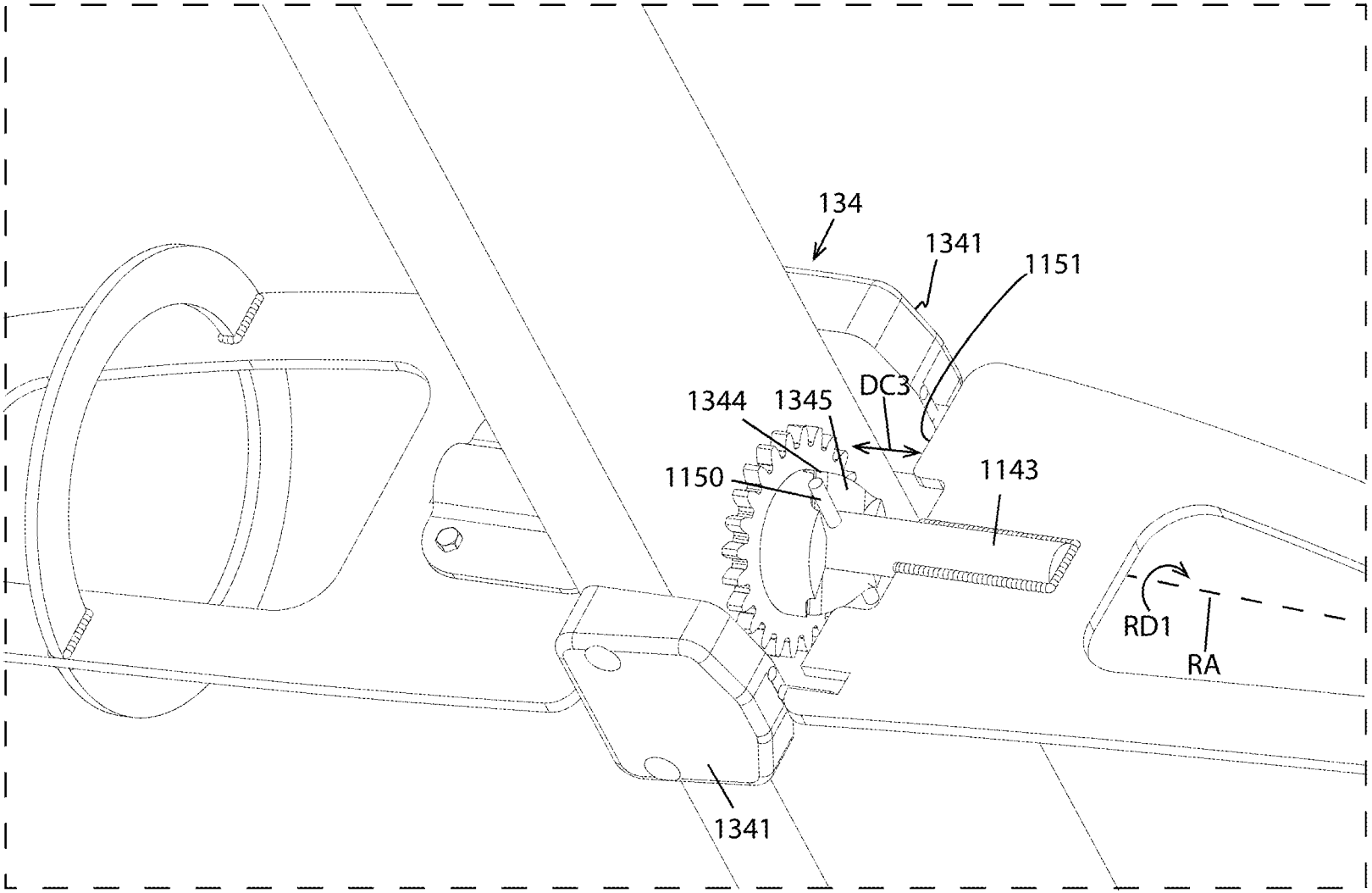
FIG. 20 is an enlarged perspective of an exemplary embodiment of a rotatable rib unit fully rotated in the RD1 (port) direction.

The cam rotor 1343 is rotatable in the first rotational direction RD1 to a port-side rib stop position depicted in FIG. 18. At the port-side rib stop position, the fixed cam 1341 extends the rib unit 114 to disengage the detent follower 1150 from the detent feature 1344 by camming engagement with the follower surface 1151 and rotation of the rib unit is stopped by the respective stop 1342. This increases the chordwise distance between the follower surface 1151 and the nearest surface of the main spar 112 to a chordwise distance DC2 greater than the corresponding chordwise distance DC1 in FIG. 19. Although rotation of the rib unit 114 in the first rotational direction RD1 is stopped, further rotation of the cam rotor 1343 in the first rotational direction is permitted. The cam rotor 1343 rotates from the port-side rib stop position depicted in FIG. 18 to a port-side rotor stop position depicted in FIG. 20. As the cam rotor rotates in the first rotational direction RD1 from the port-side rib stop position (FIG. 18) to the port-side rotor stop position (FIG. 20), the cam surface 1345 cams the detent follower 1150 to further extend the rib unit 114 to the (fully) extended configuration without rotating the rib unit. This increases the chordwise distance between the follower surface 1151 and the nearest surface of the main spar 112 to a chordwise distance DC3 greater than corresponding chordwise distance DC2 in FIG. 18. Moreover, full extension of the rib units 114 tensions the sailcloth 124 to form a taught port wind airfoil.

Figure 21:
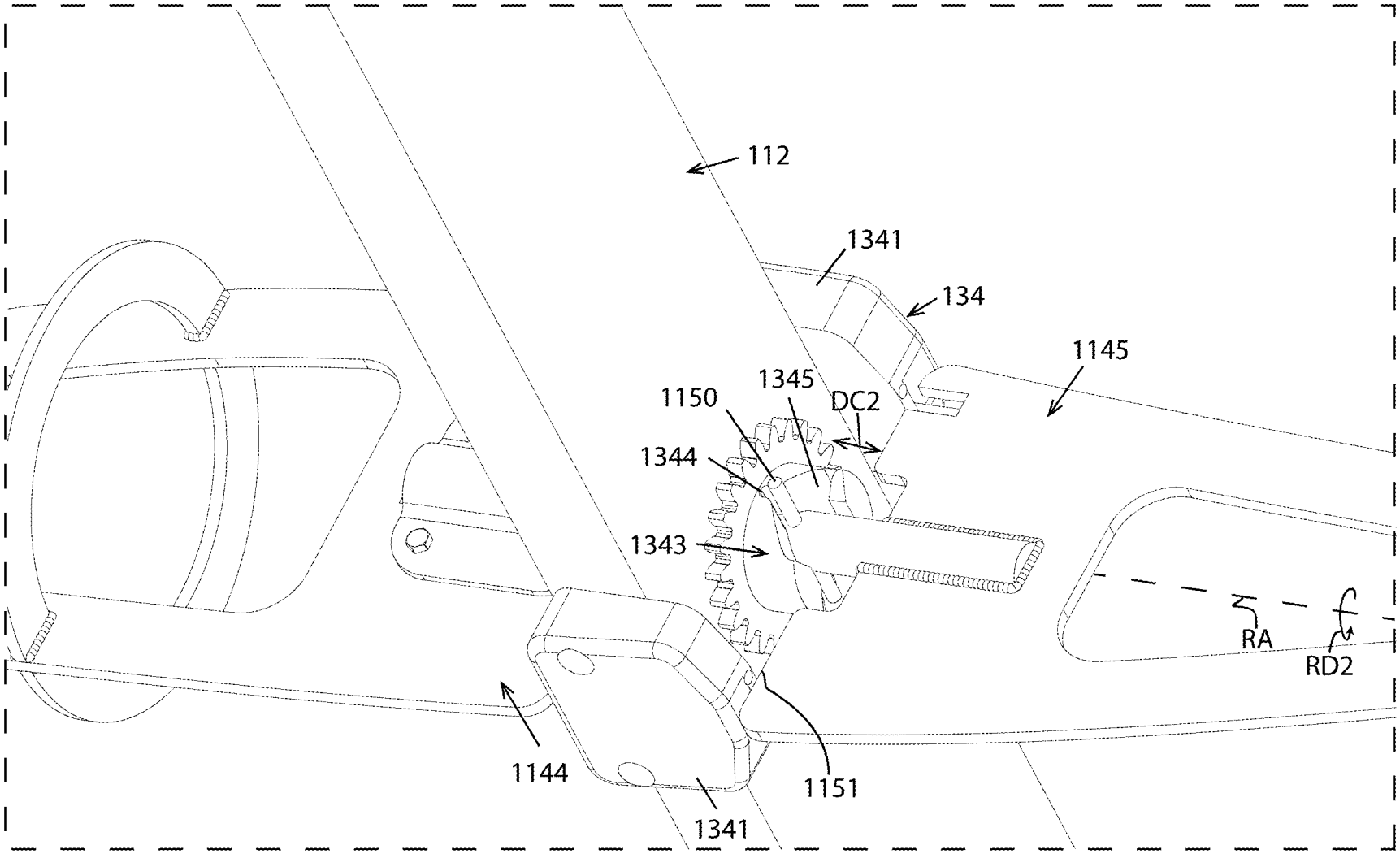
FIG. 21 is an enlarged perspective of an exemplary embodiment of a rotatable rib unit engaged with a stop in the RD2 (starboard) direction.
Figure 22:
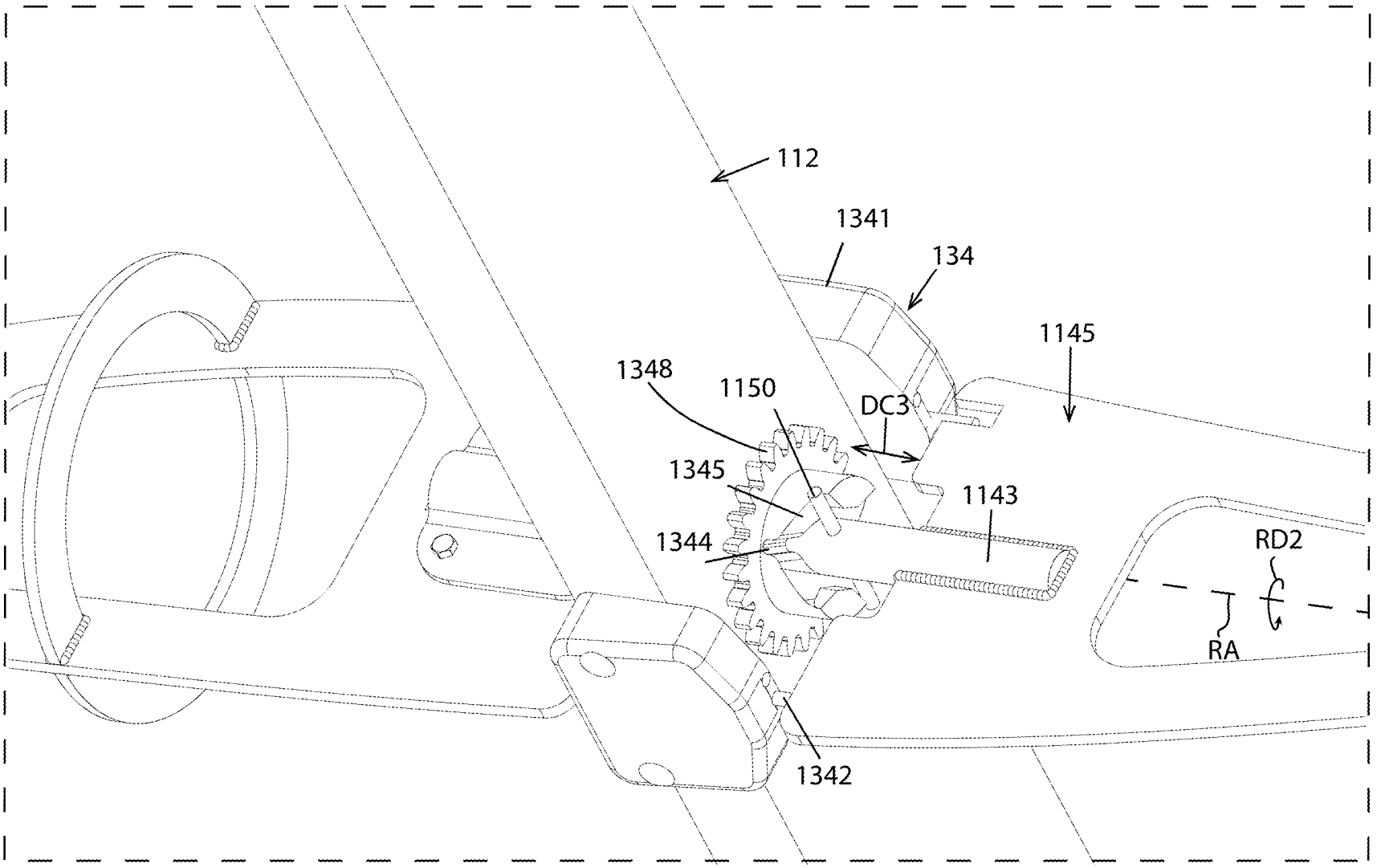
FIG. 22 is an enlarged perspective of an exemplary embodiment of a rotatable rib unit fully rotated in the RD2 (starboard) direction.

From any rotational position between the port wind position and the starboard wind position (e.g., the position depicted in FIG. 19), the cam rotor 1343 is alternatively rotatable in the second rotational direction RD2 to a starboard-side rib stop position depicted in FIG. 21. The fixed cam 1341 again extends the rib unit 114 to disengage the detent follower 1150 from the detent feature 1344 by camming engagement with the follower 1150. This increases the chordwise distance between the follower surface 1151 and the nearest surface of the main spar 112 to a chordwise distance DC2 greater than the corresponding chordwise distance DC1 in FIG. 19. The stop 1342 stops rotation of the rib unit 114 in the second rotational direction RD2 at the starboard wind position, but further rotation of the cam rotor 1343 is permitted. The cam rotor 1343 continues to rotate from the starboard-side rib stop position depicted in FIG. 21 to a starboard-side rotor stop position depicted in FIG. 22. As the cam rotor rotates 1343 in the second rotational direction RD2 from the starboard-side rib stop position to the starboard-side rotor stop position. The cam surface 1345 cams the detent follower 1150 to further extend the rib unit 114 to the (fully) extended configuration without rotating the rib unit 114. This further increases the chordwise distance between the follower surface 1151 and the nearest surface of the main spar 112 to a chordwise distance DC3 greater than corresponding chordwise distance DC2 in FIG. 21. Moreover, full extension of the rib units 114 tensions the sailcloth 124 to form a taught starboard wind airfoil.

Accordingly, it can be seen that the illustrated cam mechanisms 134 provide a double-action mechanism for extending the rib units 114 at the two respective airfoil positions and retracting the rib units at other positions. As explained in further detail below, the rotatable rib units 114 are operatively connected to the leading edge spar 116 and trailing edge spar 118 to urge the two spars apart chordwise when the rib units are extended. In this way, the rib units 114 are able to tension the sail cloth 124 by extending at the airfoil positions and to relax the sail cloth by retracting at other rotational positions.

In the illustrated embodiment, each cam rotor 1343 is a sprocket comprising sprocket teeth 1348. In one or more embodiments, the wingsail comprises a chain or cogged belt (not shown; broadly, a drive line) in meshed relationship with the sprocket teeth 1348 of each cam rotor 1343 such that the sprockets can be driven to rotate in unison in their respective ranges of motion. For example, the drive line can simultaneously rotate each cam rotor through a range of motion about the respective axis of rotation RA that extends from the starboard-side rotor stop position to the port-side rotor stop position and includes a starboard-side rib stop position, neutral position, and a port-side rib stop position between the two rotor stop positions. Alternatively, the drive line in the lower portion of the main wingsail can engage the sprockets in an S-pattern configuration, causing adjacent rib units 114 to counter-rotate. This arrangement may prevent lateral sail cloth migration and maintains rib unit positioning during main spar flexure. The drive line rotates the cam rotors in the tapered, upper portion of the main sail in a uniform direction. As will be explained in further detail below, in certain embodiments, the sailboat 10 comprises a control system that includes an electronically controllable prime mover that is configured to selectively adjust the drive line to sail the sailboat by adjusting the camber of the wingsail 110.

Figure 23:
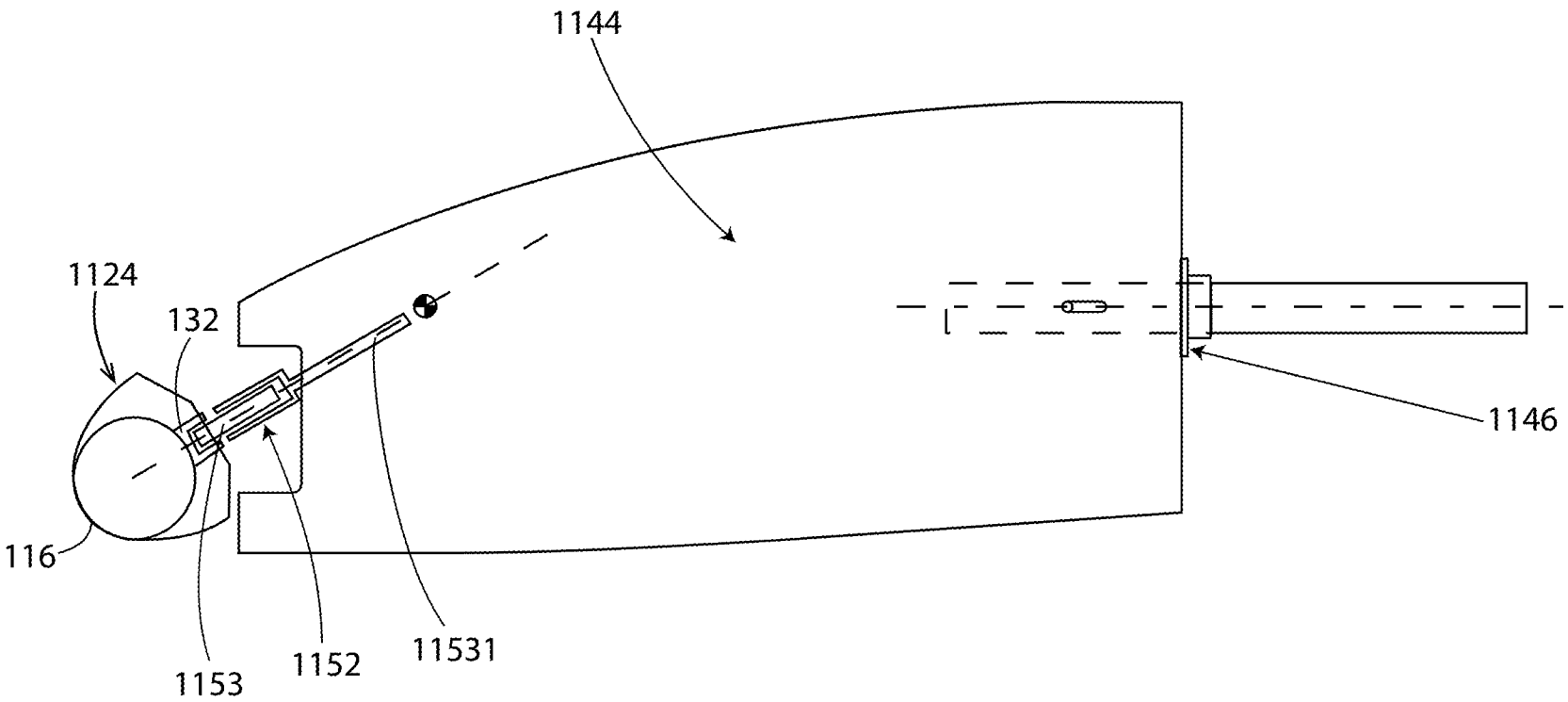
FIG. 23 is an illustrated plan view of an exemplary embodiment of a leading rib engaged with the leading edge spar.

Referring to FIG. 23, each leading rib 1144 is operably coupled to the leading edge spar 116. As explained above, the leading edge spar 114 comprises a spanwise track 132 for each rib unit 114. In the illustrated embodiment, each rib unit comprises a leading roller assembly 1152 mounted on the leading rib 1144 for operably coupling the leading rib to the leading edge spar 116 via the track 132. Each leading roller assembly 1152 comprises a roller 1153 received in the track 132 so that track constrains the roller to roll along the track. The roller 1153 is mounted on a shaft 11531 that is rotatably coupled to the leading rib 1144 so that the roller assembly and leading rib are rotatable with respect to one another about the axis of the shaft 11531. This allows the rib unit 114 to flip over while the roller 1153 stays engaged with the track 132. The track 132 and roller 1153 form a track-and-roller coupling that couples the leading rib 1144 to the leading edge spar 116 so that the leading edge spar follows the rib units 114 as the rib units rotate about their rotational axes. The track-and-roller coupling mitigates friction between the rib units 114 and the leading edge spar 116 during adjustment of the wingsail 110.

Figure 24:
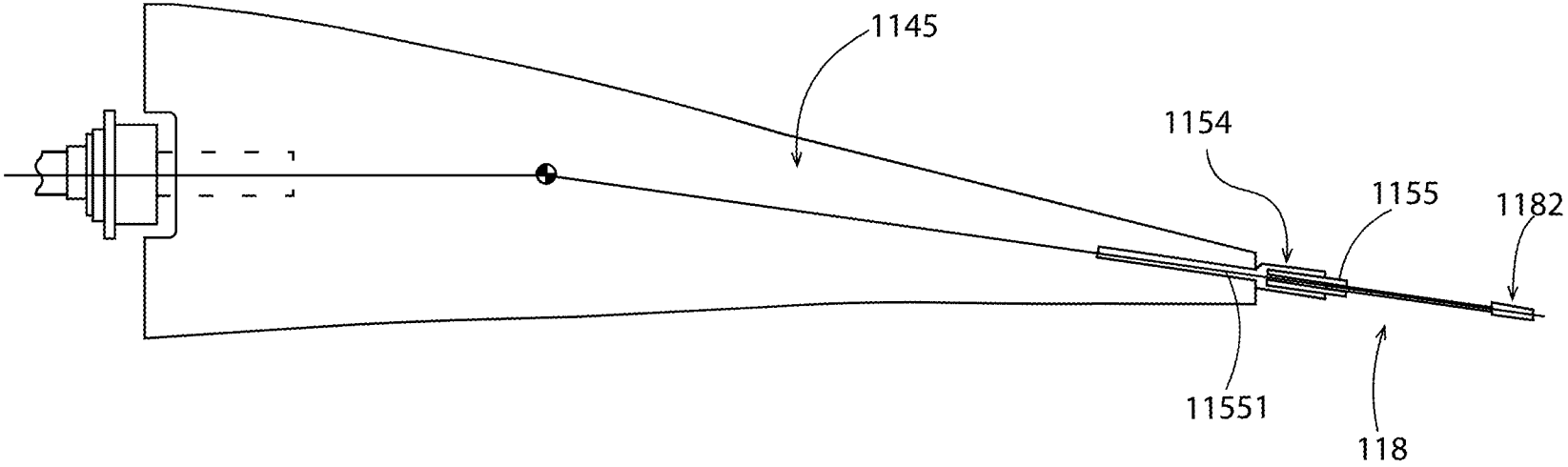
FIG. 24 is an illustrated plan view of an exemplary embodiment of a trailing rib engaged with the trailing edge spar.
Figure 25:
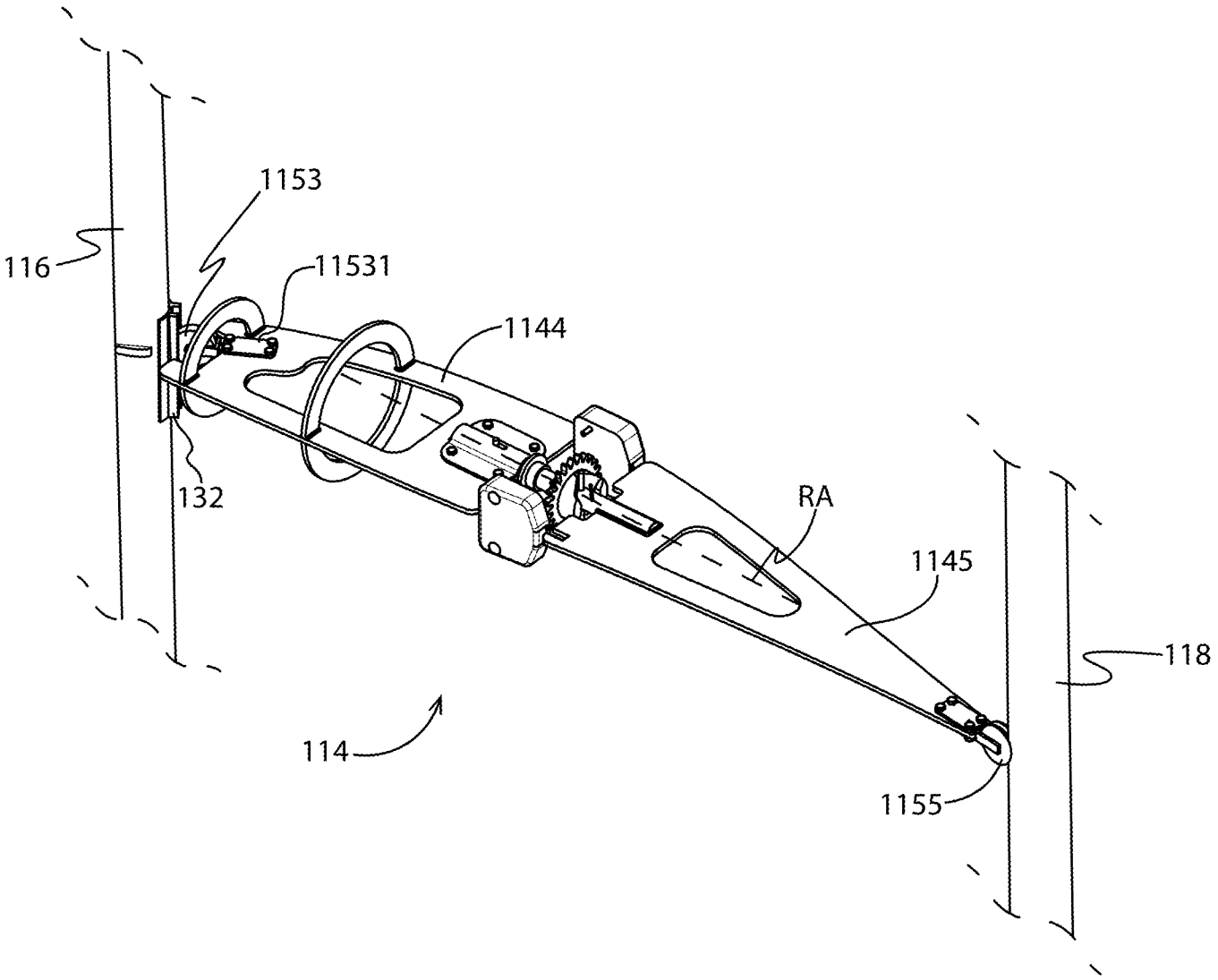
FIG. 25 is a perspective view of an exemplary embodiment of a rotatable rib unit.
Figure 26:
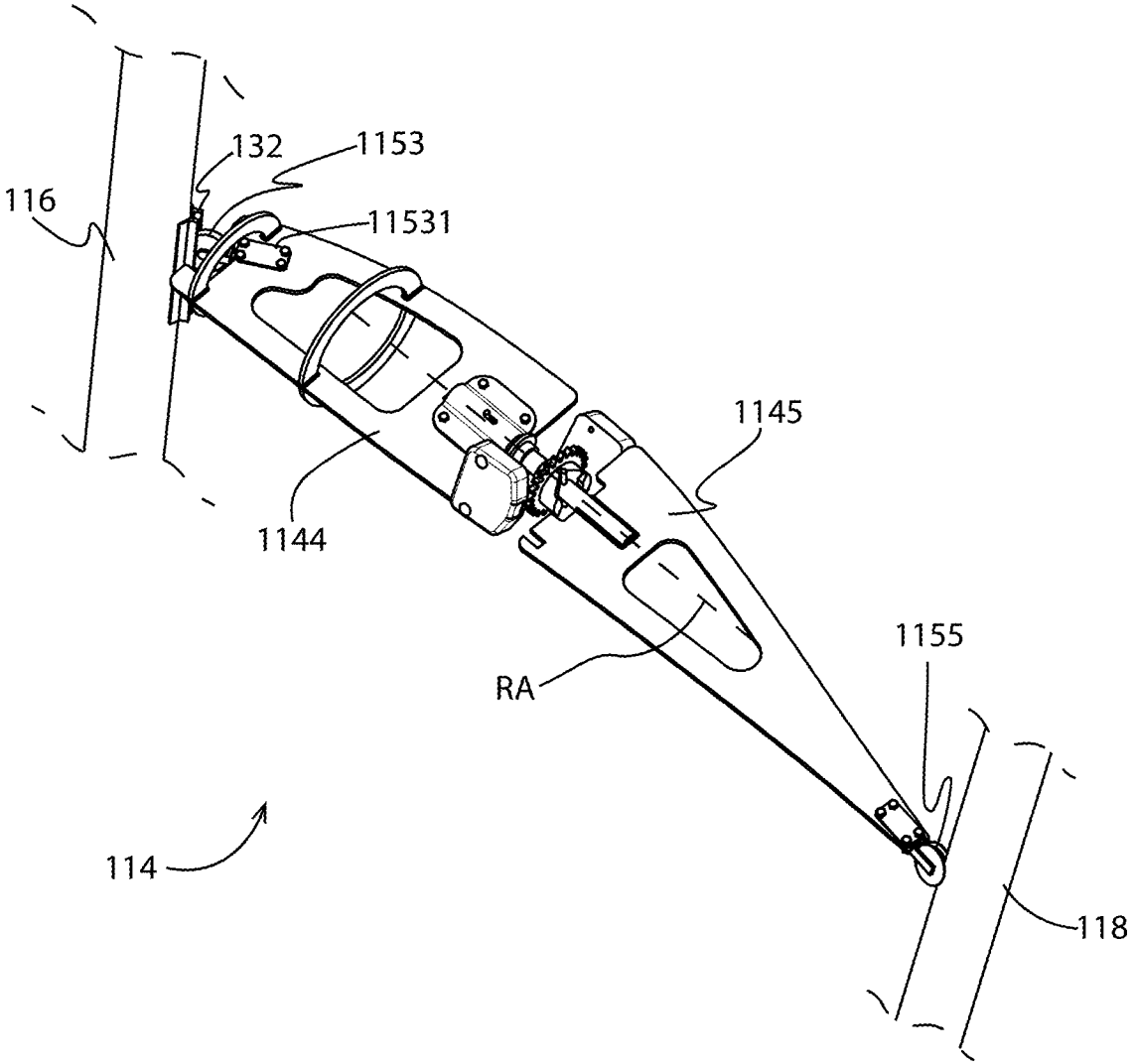
FIG. 26 is a perspective view of an exemplary embodiment of a rotatable rib unit.

Referring to FIG. 24, each trailing rib 1145 is operably coupled to the trailing edge spar 118. As explained above, the trailing edge spar 118 comprises a plate layer 1182 having an edge margin forming a roller guide extending spanwise. Each rib unit 114 comprises a trailing roller assembly 1154 mounted on the trailing rib 1145. Each trailing roller assembly 1154 comprises a roller 1155 having a channel-shaped bearing surface. The roller guide of the trailing edge spar 118 is received in the channel-shaped bearing surface of each roller 1155 so that the roller guide constrains the roller to roll along the roller guide. The roller 1155 is mounted on a shaft 11551 that is rotatably coupled to the trailing rib 1145 so that the roller assembly and trailing rib are rotatable with respect to one another about the axis of the shaft. This allows the rib unit 114 to flip over while the roller 1155 stays engaged with the roller guide. The roller guide and each roller 1155 form a roller edge coupling that couples the trailing rib 1145 to the trailing edge spar 118 so that the trailing edge spar follows the rib units 114 as the rib units rotate about their rotational axes RA. The roller edge coupling mitigates friction between the rib units 114 and the leading edge spar 116 during adjustment of the wingsail 110.

Figure 27:
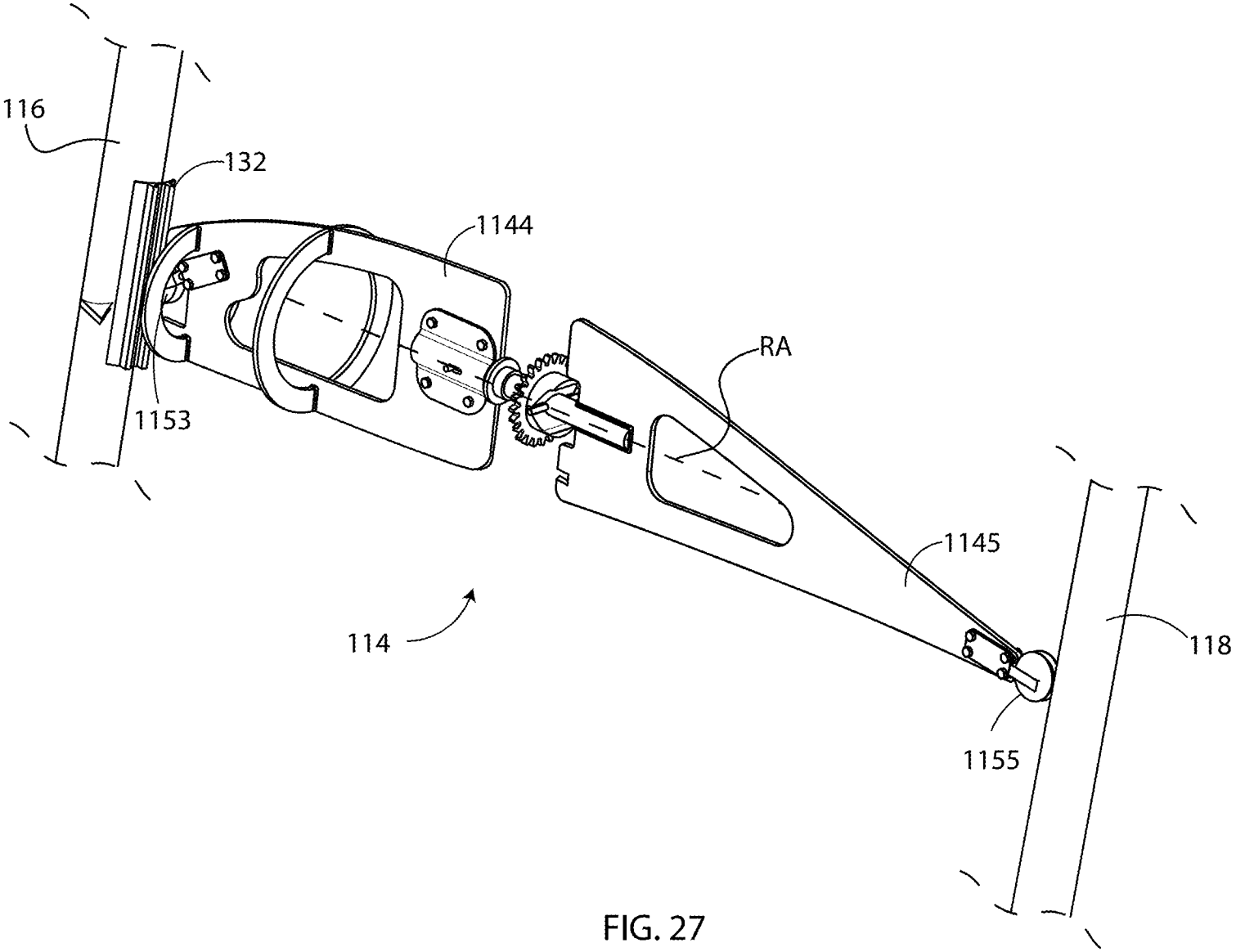
FIG. 27 is a perspective view of an exemplary embodiment of a rotatable rib unit.
Figure 28:
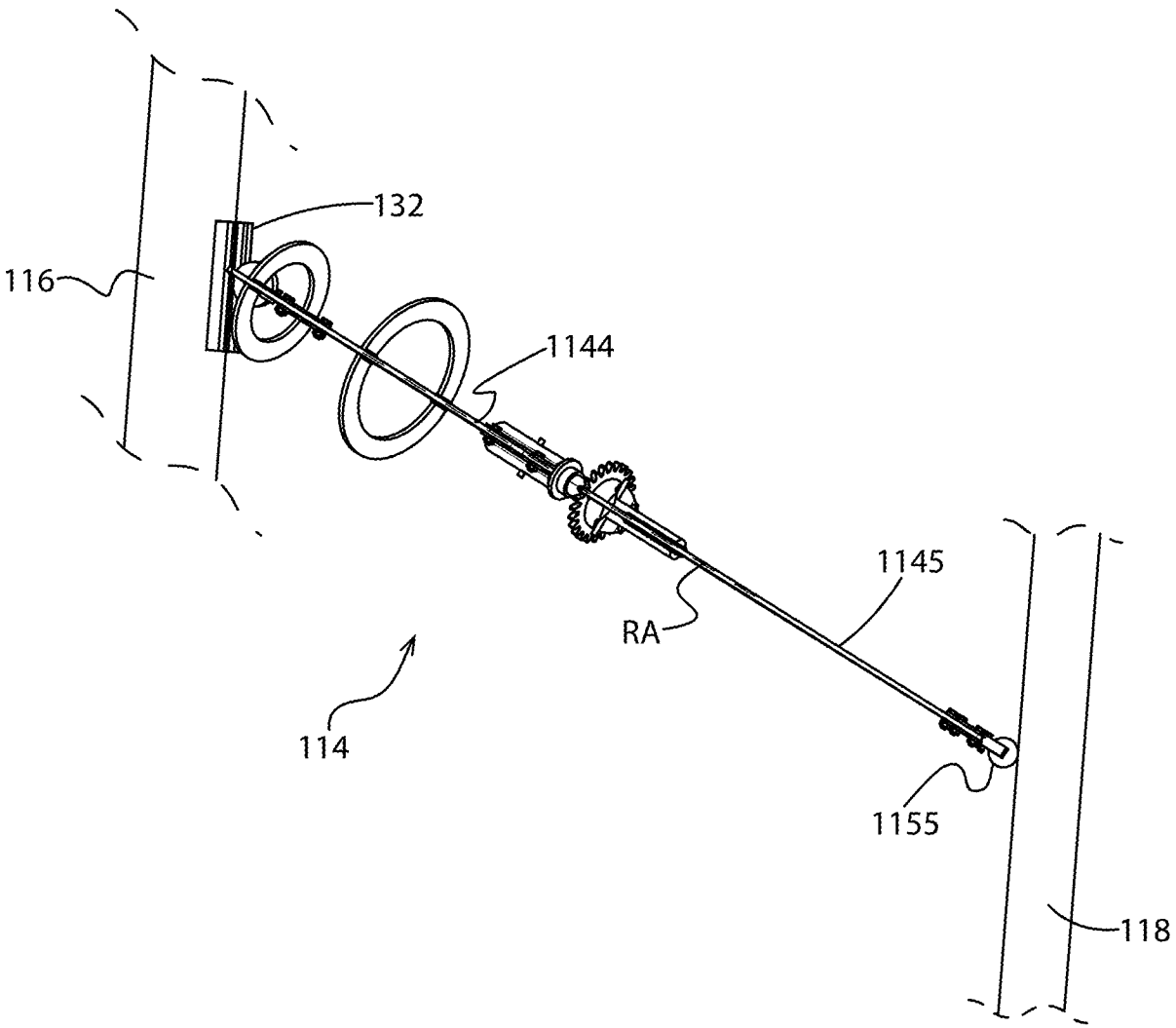
FIG. 28 is a perspective view of an exemplary embodiment of a rotatable rib unit.
Figure 29:
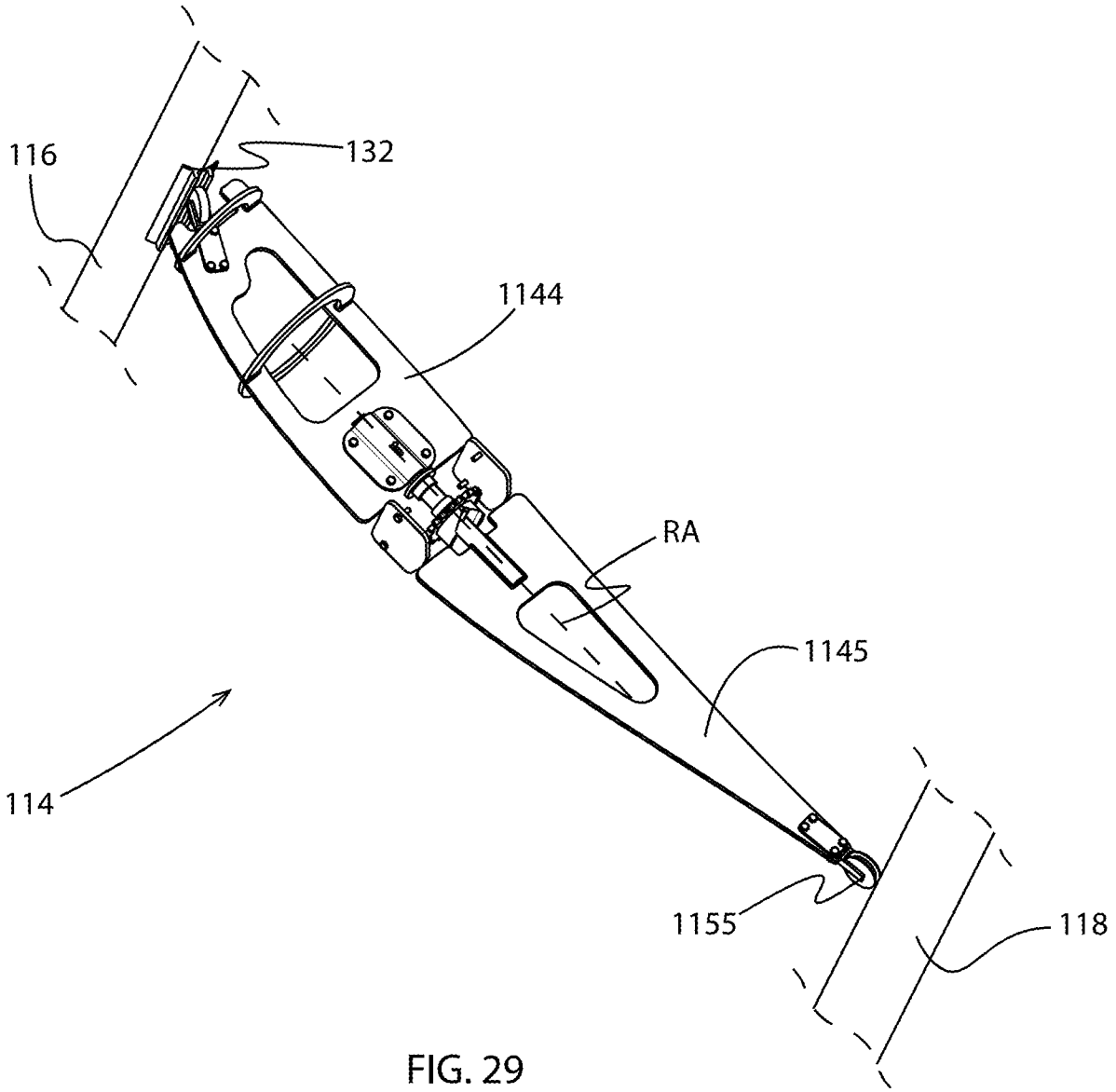
FIG. 29 is a perspective view of an exemplary embodiment of a rotatable rib unit.

FIGS. 25-29, one example of rotation of a rib unit 114 about the axis of rotation RA from a port wind position (FIG. 25) to a starboard wind position (FIG. 29) is shown to aid in understanding. As can be seen here, the leading edge roller 1153 rolls along the track 132 and the leading rib 1144 rotates about the shaft 11531 of the leading edge roller as the rib unit 114 rotates about the axis of rotation RA. Likewise, the trailing edge roller 1155 rolls along the roller guide of the trailing edge spar 118 and the trailing rib 1145 rotates with respect to the shaft 11551 of the trailing edge roller 1155 as the rib unit 114 rotates about the axis of rotation RA. In the illustrated embodiment, each rib unit rotates about 180° about the respective axis of rotation RA between the respective port wind position to the respective starboard wind position. The neutral position of the rib unit 114 is halfway between the port wind position and the starboard wind position, as shown in FIG. 27.

Figure 30:
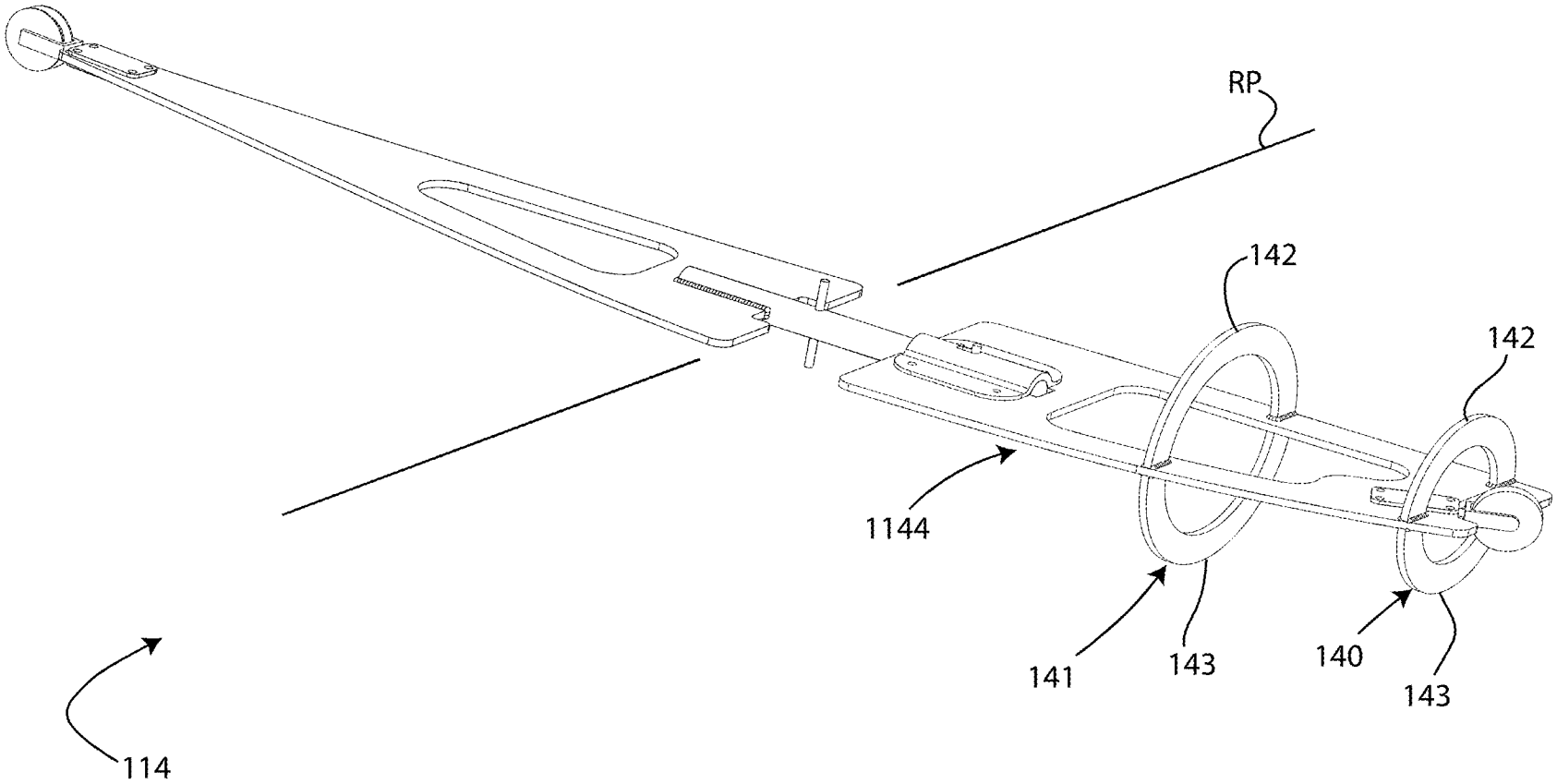
FIG. 30 is a perspective view of an exemplary embodiment of a rotatable rib unit.
Figure 31:
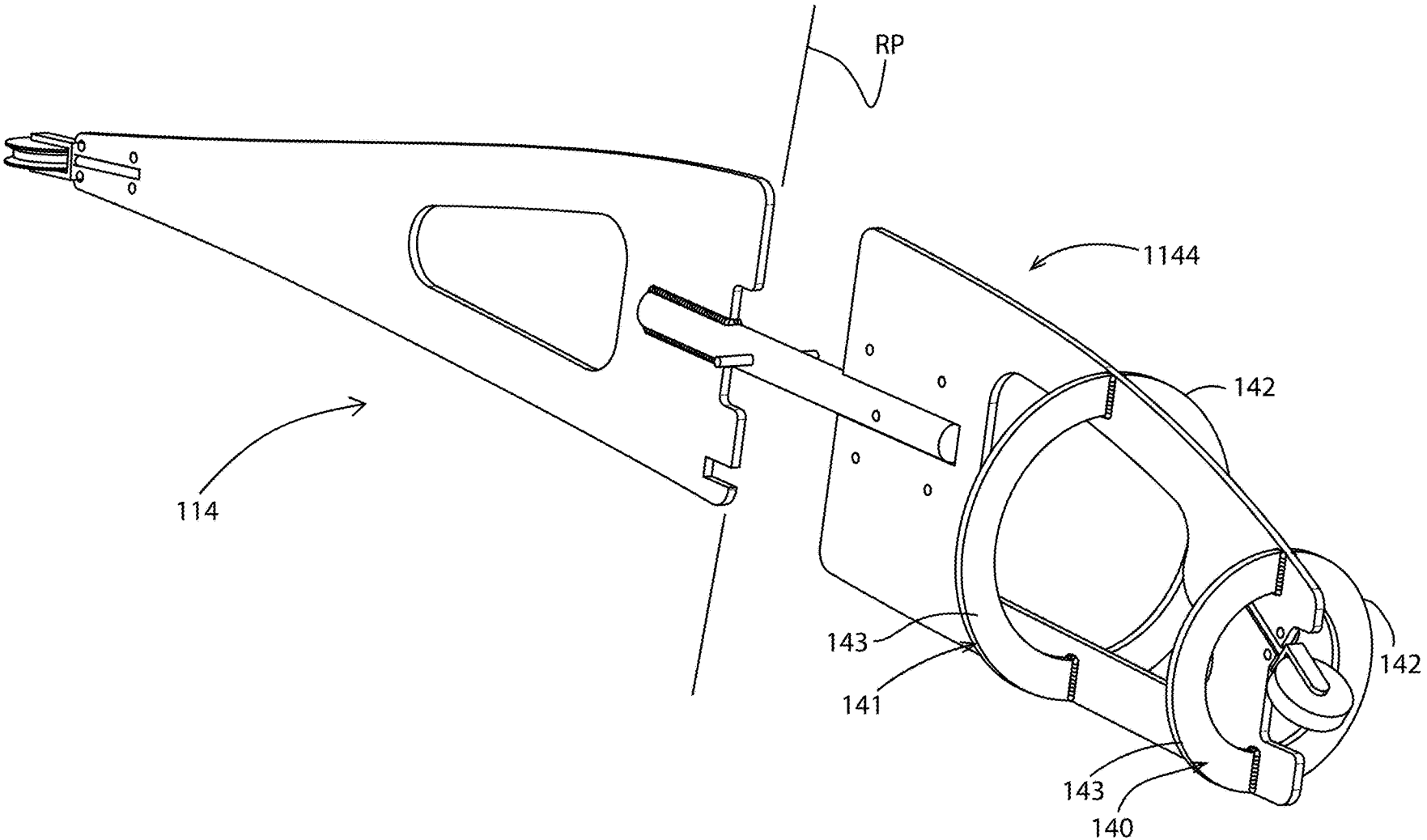
FIG. 31 is a perspective view of an exemplary embodiment of a rotatable rib unit.
Figure 32:
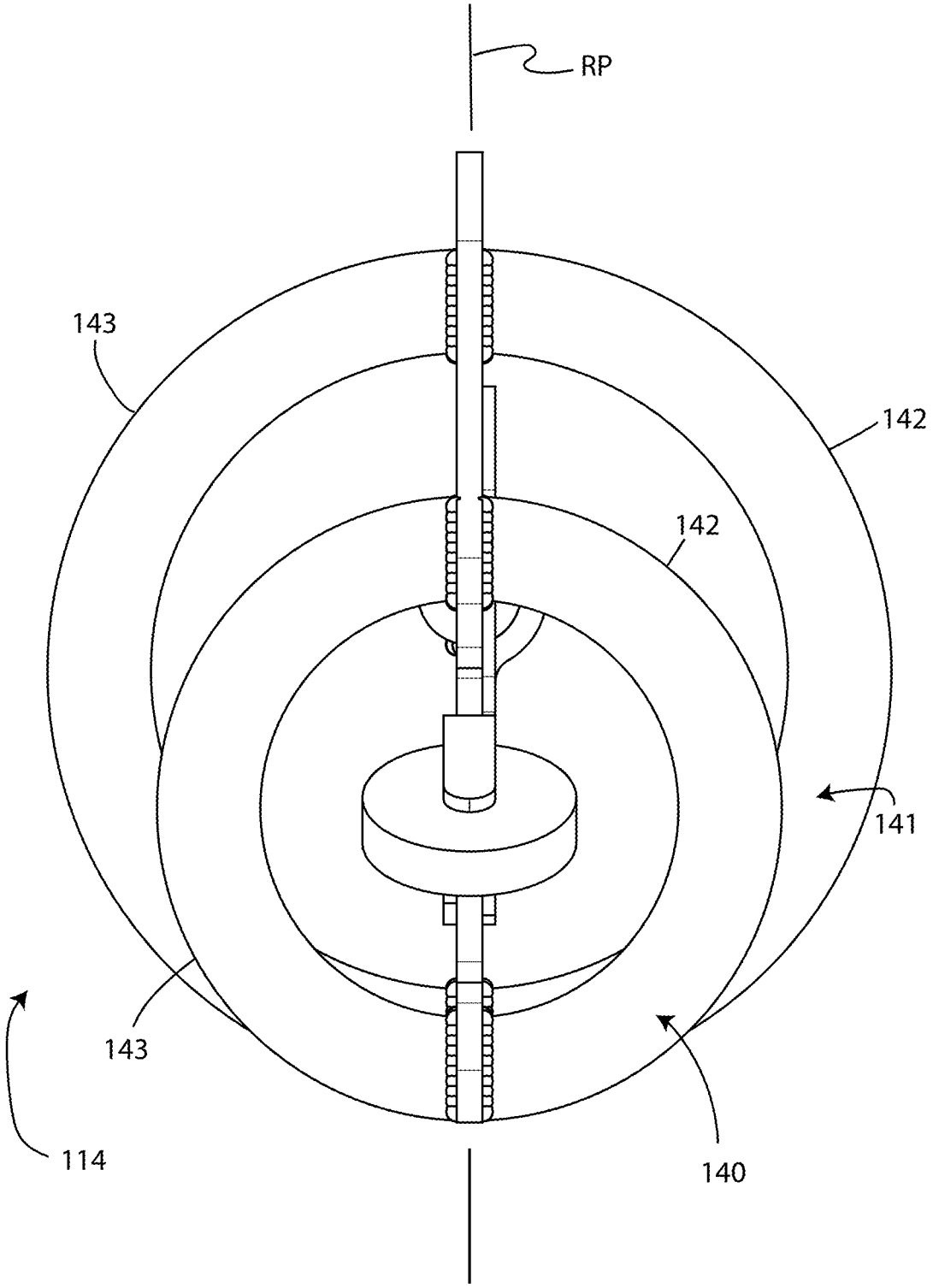
FIG. 32 is a front elevation view of an exemplary embodiment of a rotatable rib unit.

Referring to FIGS. 30-32, in order to form the wingsail 110 into a symmetrical airfoil when the rib units 118 are rotated to the neutral positions, each rib unit 118 is fitted with at least one former 140, 141 extending transverse to the respective rib plane RP. Each former 140, 141 includes a first neutral forming surface 142 on a first side of respective rib plane RP and a second neutral forming surface 143 on a second side of the respective rib plane. The first neutral forming surface 142 and the second neutral forming surface 143 are symmetrical with respect to the respective rib plane RP. More specifically, in the illustrated embodiment, the first and second neutral forming surfaces 142, 143 of each respective former 140, 141 define a respective circular forming surface bisected by the rib plane RP. In one or more embodiments, the upper aerodynamic edge 1142 and lower aerodynamic edge 1141 of the rib unit lie on the circular forming surfaces of the first and second formers 140, 141. In certain embodiments, one or more formers 140, 141 are mounted on the leading rib 144 and the trailing rib 1145 is free of out-of-plane formers. In the illustrated embodiment, the second former 141 is aft of the first former 140 and the circular forming surface of the second former has a greater radius than the circular forming surface of the first former.

Figure 33:
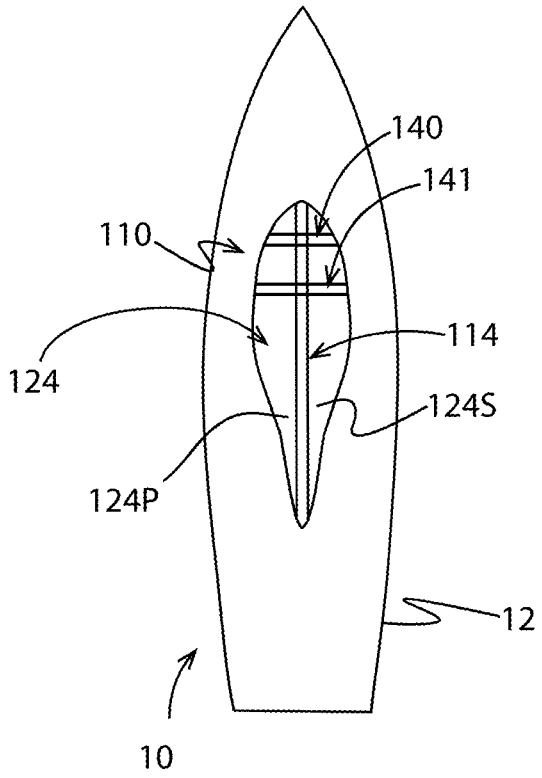
FIG. 33 is a schematic of a sailboat in accordance with the present disclosure.

FIG. 32 illustrates a rib unit 114 rotated to a neutral position in which the rib plane extends spanwise. Referring to FIG. 33, when the rib units 114 are rotated to the neutral positions, the rib units adjust the sailcloth 124 to form a symmetrical airfoil by forming the port side sheet portion 124P over the first neutral forming surfaces 142 of the formers 140, 141 and by forming the starboard side sheet portion 124S over the second neutral forming surfaces 143 of the formers. When the rib units 114 are oriented in the neutral positions, the wingsail 110 is, thus, symmetrical on opposite sides of a plane defined by the spanwise axis SWA and a chordwise axis of the wingsail. In this configuration, no lift is created by wind passing over the wingsail 110 when the trim tab 165 is in the neutral position. Thus the sailboat 10 can be moored safely, with small adjustments to the sailboat speed and position, when the rib units 114 are rotated to the neutral positions to form the wingsail 110 into a symmetrical airfoil. In addition, the sailboat 10 can be safely driven by an auxiliary power source (e.g., an electric or gas-powered motor) to, for example, navigate in a crowded harbor.

Referring again to FIG. 5, in the illustrated embodiment, the chord dimension of the wingsail 110 decreases along the upper span of the wingsail. Accordingly, the rib units 114', 114", 114'" used along the upper span of the wingsail 110 are modified relative to the rib units 114 to account for the smaller chord dimension. In addition, the size and shape of the leading and trailing ribs of the upper rib units 114', 114", 114'" are adjusted in accordance with the reduction in chord dimension.

Figure 34:
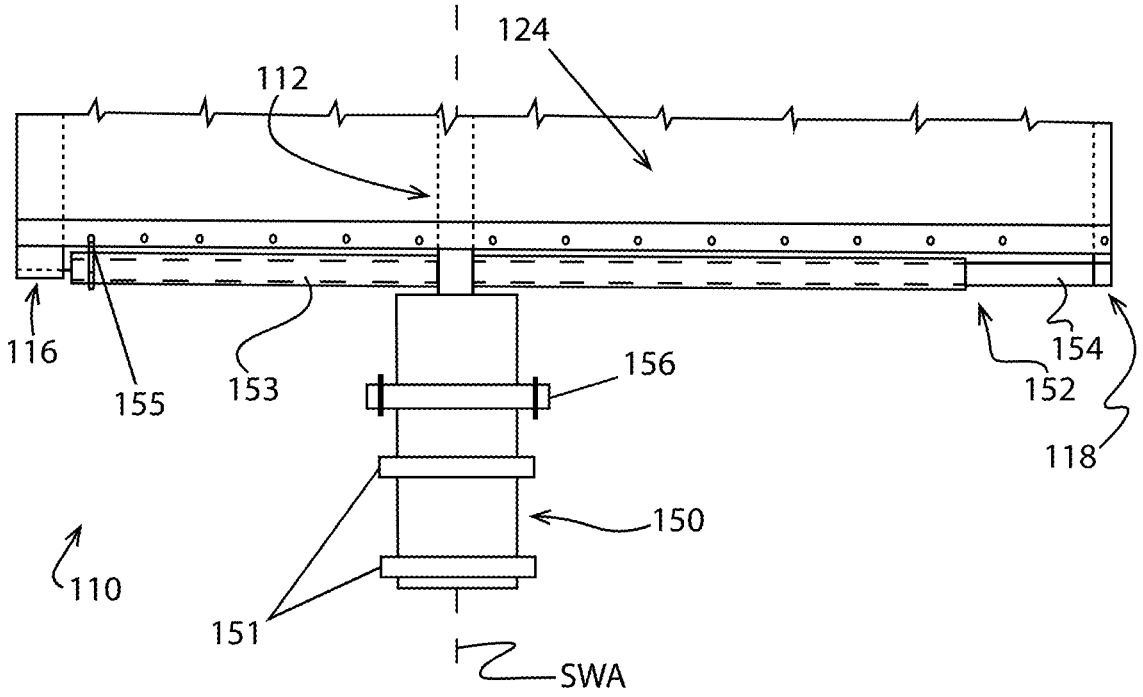
FIG. 34 is an illustrated elevation view of an exemplary embodiment of a base of the main wingsail.

Referring to FIG. 34, in one or more embodiments, the wingsail 110 further comprises a base 150 configured to be rotatably mounted in the hull 12 of the sailboat such that the entire wingsail is rotatable with respect to the vessel about the spanwise axis SWA. The lower section of the base 150 includes bearings 151 that allow the wingsail 110 to rotate 360° about the SWA. In the illustrated embodiment, the base 150 comprises an aluminum cylinder that connects to the sailboat hull 12 via the flange 156, enabling selective wingsail detachment from and attachment to the hull. This wingsail detachment is needed for travel under low clearance bridges and for trailering. Alternative mounting configurations facilitating rotatable engagement between the wingsail and hull may be implemented while remaining within the scope of the disclosure. Not shown is a prime mover which is used to move the chain or belt that engages the sprockets 1343. The prime mover may comprise a servo motor operatively connected to the drive line to rotate the rib units in a synchronized manner.

Referring still to FIG. 34, the wingsail 110 can further comprise sail tensioners 152 mounted on the upper and lower end portion of the main spar 112, respectively. Only the lower sail tensioner 152 is shown in FIG. 34, but it will be understood that the upper sail tensioner can have a substantially similar configuration. The sail tensioner 152 comprises one or more tensioning tubes 153 and tensioning plates 154 to which the sailcloth 124 can be secured to tension the sailcloth spanwise. In the illustrated embodiment, the sail tensioner 152 comprises a forward tube 153 and an aft plate 154 in telescoping relationship with the forward tube. The forward tensioning tube 153 is coupled to the leading edge spar 116, and the aft tensioning plate 154 is coupled to the trailing edge spar 118. Elastic bands 155 are used to secure the lower edge margin of the sailcloth 124 to the lower sail tensioner 152. Similarly, elastic bands are likewise used to secure the upper edge margin of the sail cloth to an elastomeric upper tensioner (not shown). The sailcloth 124 is fixedly attached to the trailing edge spar 118 via an adjustment zone that allows initial positioning during installation. The sailcloth 124 is elastically attached to the lower sail tensioner 152 and upper sail tensioner (not shown); however the sailcloth is not attached to the leading edge spar 116, making it possible for the sailcloth to slide over the leading edge spar 116 as the rib units 114 rotate.

Figure 35:
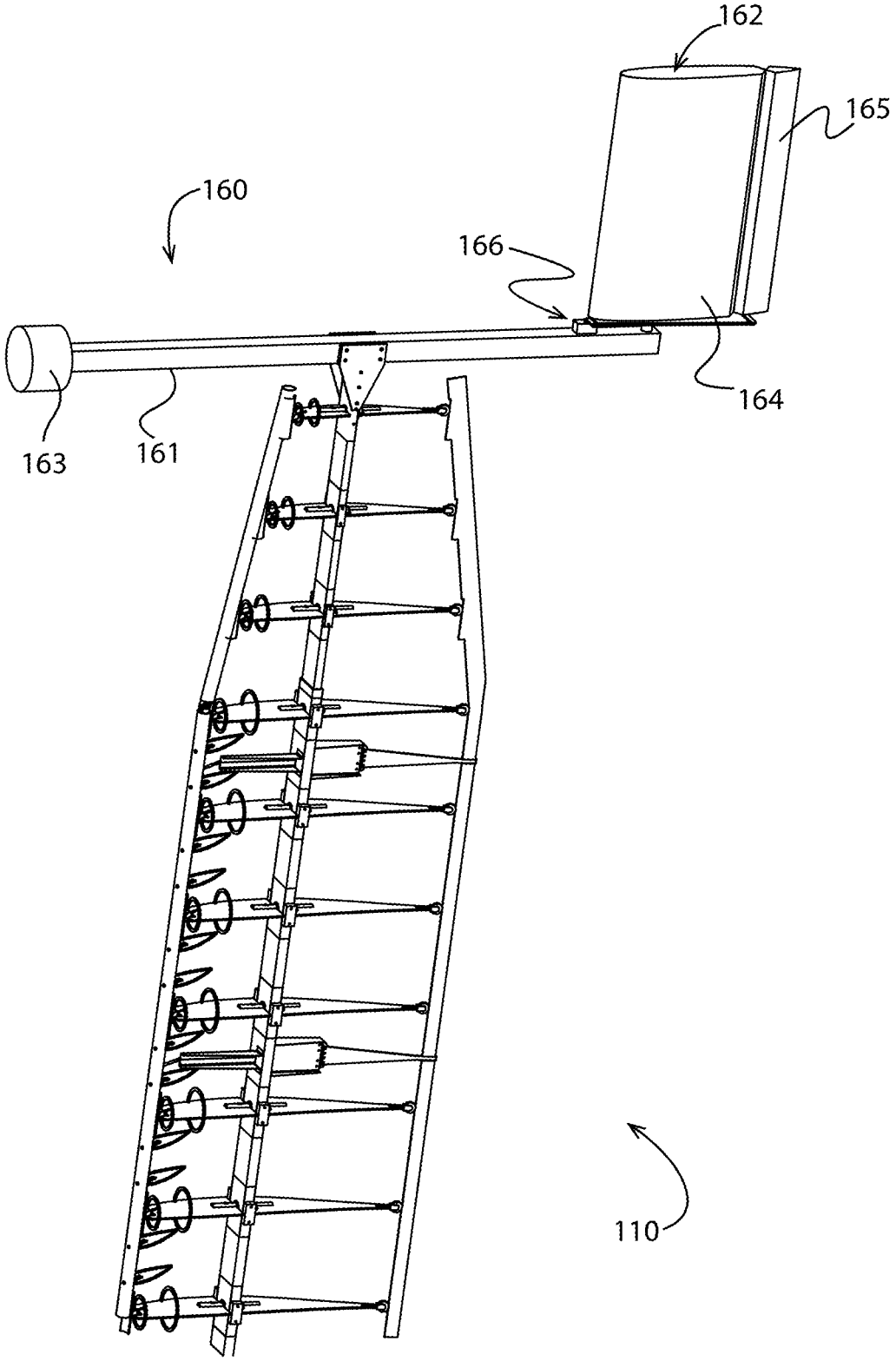
FIG. 35 is a perspective view of an exemplary embodiment of the wingsail with an air rudder assembly.
Figure 36:
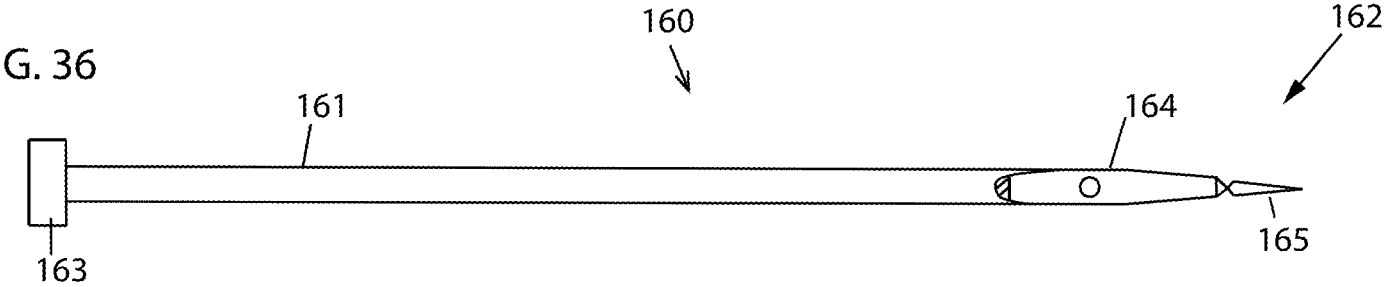
FIG. 36 is an illustrated plan view of an exemplary embodiment of an air rudder assembly.
Figure 37:
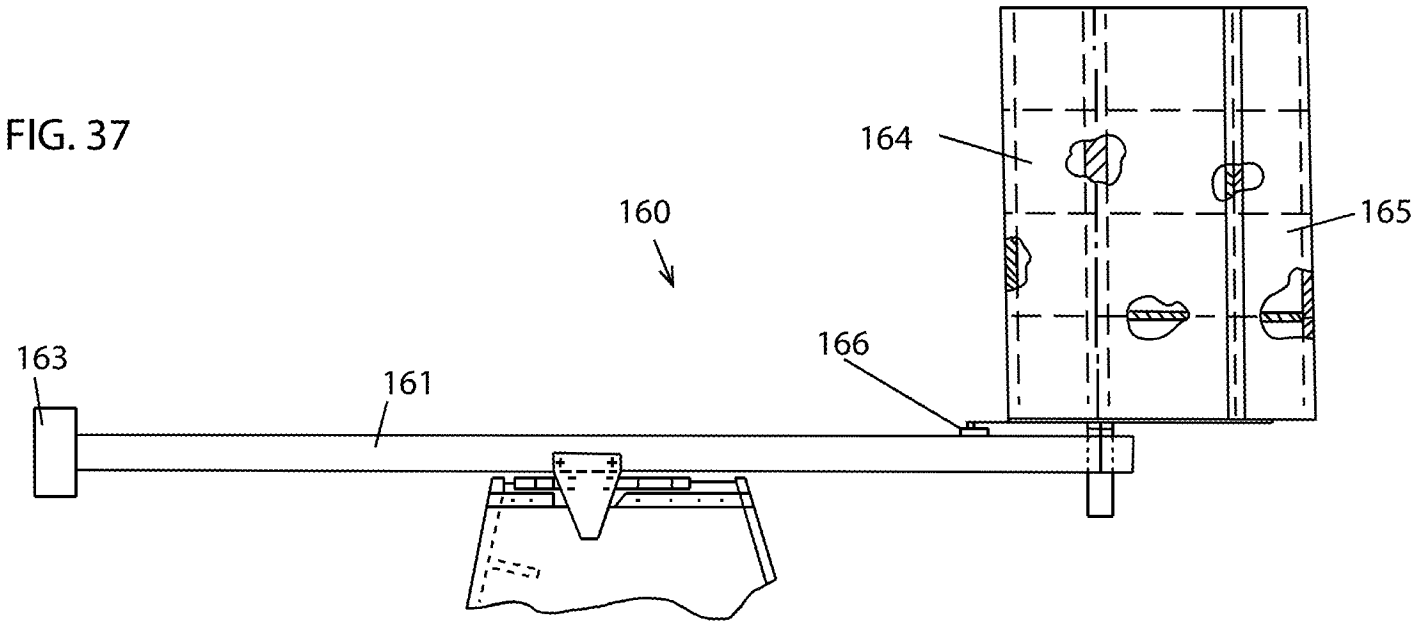
FIG. 37 is an illustrated elevation view of exemplary embodiment of an air rudder assembly.
Figure 38:
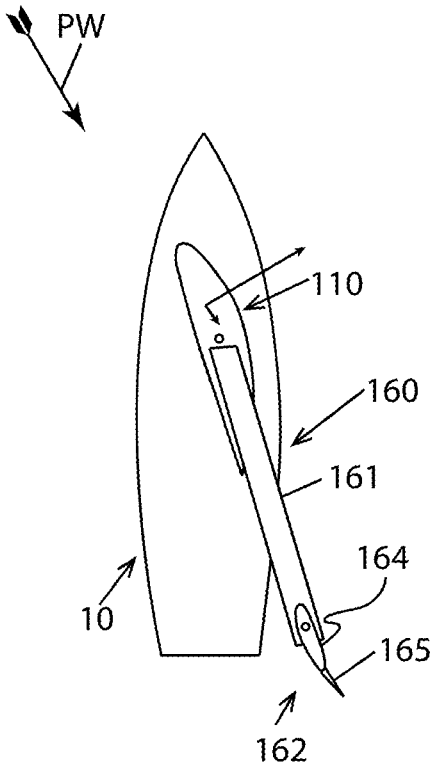
FIG. 38 is a schematic of an exemplary embodiment of a sailboat in accordance with the present disclosure.

Referring now to FIGS. 35-37, in one more embodiments, the sailboat 10 further comprises an air rudder assembly 160 to aid in controlling the angle of attack of the wingsail 110. The angle of attack refers to the angle between the wingsail's chord line (a line connecting the leading and trailing edges of the wingsail) and the wind direction. The air rudder assembly 160 generally comprises a stabilizer arm 161 mounted on the upper end portion of the main spar 112, an air rudder 162 mounted on the aft end of the stabilizer arm, and a counterbalance weight 163 mounted on the forward end of the stabilizer arm. The counterbalance weight 163 helps prevent gust disturbance to the wingsail angle of attack. The air rudder 162 comprises a main stabilizer body 164 and an adjustable trim tab 165 connected to the main stabilizer body by a hinge. The main stabilizer body 164 is mounted to the stabilizer arm 161 with bearings, allowing the main stabilizer body to freely rotate about the stabilizer arm. An actuator 166 is configured to selectively rotate the anti-servo trim tab 165 in port and starboard directions in relation to the main stabilizer body 164 to aid in controlling the angle of attack of the wingsail and the air rudder. For example, FIG. 38 depicts an example position in which the wingsail 110 is formed as a port wind high lift airfoil and the trim tab is rotated in the starboard direction. Trim tab adjustments modulate the wingsail angle of attack in response to different sailing conditions. For example, as the wind intensity changes, the trim tab may be adjusted to alter the angle of attack, effectively changing the speed of the sailboat. In an embodiment, the actuator 166 accomplishes trim tab 165 movement with a bell crank linkage (not shown), wherein the bell crank, mounted to the stabilizer body 164, interfaces with connecting links that couple the actuator 166 to the trim tab 165, facilitating movement of the trim tab throughout its operational range.

Figure 39:
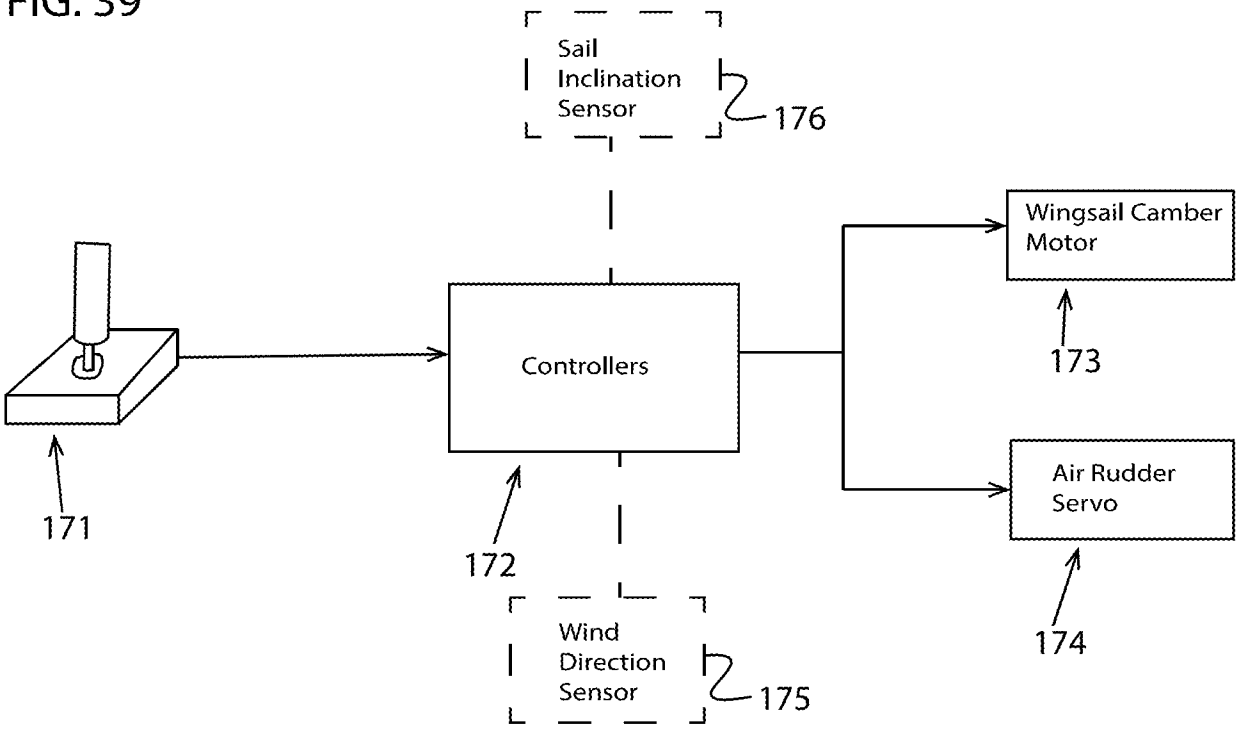
FIG. 39 is a schematic of a control system for the sailboat.

Referring to FIG. 39, an exemplary embodiment of a control system for the sailboat 10 is generally indicated at reference number 170. The control system 10 comprises a user input device 171, a controller 172, a wingsail camber motor 173, and an air rudder servo motor 166. The wingsail camber motor 173 is operatively connected to the above-described drive line (not shown) so that the wingsail camber motor can selectively rotate the rib units 114 (all simultaneously) through their ranges of motion. The air rudder servo motor 166 is the actuator for controlling the trim tab 165 described above. In the illustrated embodiment, a user can control the wingsail 110 by making user inputs via the user input device 171; and in response, the controller 172 will automatically actuate the wingsail camber motor 173 to adjust the camber of the wingsail 110 and selectively actuate the air rudder servo motor 166 to adjust the air rudder 162.

It is envisioned that the user input device 171 could comprise a joystick, steering wheel, or game controller-type user input device that enables the user to make intuitive directional inputs for controlling the sailboat. In this way, the sailboat 10 can be operated without the extensive training and experience usually needed for conventional sailboat operation.

It is understood that the controller 172 is preprogrammed to automatically adjust the wingsail camber and air rudder position in response to user inputs that indicate a desired angle of attack for the wingsail. In certain embodiments, the controller 172 could be further connected to a wind direction sensor 175 that outputs a signal indicating the direction of wind in relation to the sailboat 10. The controller 172 may suitably account for the information provided by the wind direction sensor 175 when adjusting the wingsail camber motor 173 and air rudder servo motor 166 to control the angle of attack of the wingsail. Optionally, a sail inclination sensor 176 could be connected to the controller 172 to sense changes in the angle of the wingsail 110 in the spanwise axis SWA, and beyond a programmed limit of inclination, the controller 172 may automatically adjust the air rudder position to prevent the sailboat from tipping over.

It will be understood that the control system 170 is but one possible way of controlling a sailboat 10 equipped with the wingsail 110. It is contemplated that other embodiments may be configured for manual control of the drive line and/or air rudder. In still other embodiments, the sailboat 10 may comprise a control system that adjusts the wingsail 110 (and air rudder 162) automatically based on a navigation input indicating the location (e.g., GPS location) of a destination for the sailboat. Still other ways of controlling the sailboat may be used without departing from the scope of the disclosure.

It can now be seen that the present disclosure provides a reversible camber wingsail that can effectively switch between two high lift airfoil configurations to enable a sailboat to efficiently tack upwind. In some embodiments, the reversible camber wingsail can selectively tension and relax the sailcloth so that the camber can feasibly be reversed without requiring an excessive amount of force or wear applied to the sailcloth. In certain embodiments, the reversible camber wingsail of the present disclosure provides, not only two high lift airfoil configurations, but also a symmetrical airfoil configuration that enables mooring the sailboat, fine control, or driving the sailboat using an auxiliary power source. Still furthermore, the reversible camber wingsail of the present disclosure is able to be controlled by an intuitive user input device, which substantially lowers the barrier to entry for sailing in terms of skills and experience.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the disclosure are achieved and other advantageous results attained.

As various changes could be made in the above products and methods without departing from the scope of the disclosure, it is intended that all matter contained in the above description shall be interpreted as illustrative and not in a limiting sense.

What is claimed is:

1. A reversible camber wingsail, the wingsail having a spanwise axis, a port side, and a starboard side, the wingsail comprising:

a spar extending along the spanwise axis;

a plurality of rib units connected to the spar at spaced apart locations along the spanwise axis, each rib unit having a respective rib plane and configured to define a high lift airfoil profile in the respective rib plane including an aerodynamic lower profile edge and an aerodynamic upper profile edge, each rib unit having a respective axis of rotation in the respective rib plane extending transverse to the spanwise axis, each rib unit being rotatable about the axis of rotation from a port wind position to a starboard wind position, wherein in the respective port wind position, each rib unit is oriented so the respective aerodynamic lower profile edge is on the port side of the wingsail and the respective aerodynamic upper profile edge is on the starboard side of the wingsail, and wherein in the respective starboard wind position, each rib unit is oriented so the respective aerodynamic lower profile edge is on the starboard side of the wingsail and the respective aerodynamic upper profile edge is on the port side of the wingsail; and a sailcloth comprising a port side sheet portion and a starboard side sheet portion, the sailcloth covering the plurality of rib units such that the rib units are received between the port side sheet portion and the starboard side sheet portion;

wherein when the rib units are oriented in port wind positions, the rib units adjust the sailcloth to form a port wind high lift airfoil by forming the port side sheet portion over the aerodynamic lower profile edges of the rib units to define an aerodynamic lower surface of the port wind high lift airfoil and by forming the starboard side sheet portion over the aerodynamic upper profile edges of the rib units to form an aerodynamic upper surface of the port wind high lift airfoil; and wherein when the rib units are oriented in starboard wind positions, the rib units adjust the sailcloth to form a starboard wind high lift airfoil by forming the port side sheet portion over the aerodynamic upper profile edges of the rib units to define an aerodynamic upper surface of the starboard wind high lift airfoil and by forming the starboard side sheet portion over the aerodynamic lower profile edges of the rib units to form an aerodynamic lower surface of the starboard wind high lift airfoil.

2. The wingsail of claim 1, wherein each rib unit rotates about 180° about the respective axis of rotation between the respective port wind position to the respective starboard wind position.

3. The wingsail of claim 1, wherein each rib unit is rotatable to a neutral position between the respective port wind position and the respective starboard wind position; wherein when the rib units are oriented in the neutral positions, the wingsail is symmetrical on opposite sides of a plane defined by the spanwise axis and a chordwise axis of the wingsail.

4. The wingsail of claim 3, wherein each rib unit comprises at least one former extending transverse to the respective rib plane, each former including a first neutral forming surface on a first side of respective rib plane and a second neutral forming surface on a second side of the respective rib plane, the first neutral forming surface and the second neutral forming surface being symmetrical with respect to the respective rib plane; wherein when the rib units are oriented in the neutral positions, the rib units adjust the sailcloth to form a symmetrical airfoil by forming the port side sheet portion over the first neutral forming surfaces of the rib units and by forming the starboard side sheet portion over the second neutral forming surfaces of the rib units.

5. The wingsail of claim 1, wherein the spar comprises a main spar, each rib unit comprising a drive shaft rotatably connected to the main spar, a leading rib mounted on the drive shaft forward of the main spar for rotation with the drive shaft, and a trailing rib mounted on the drive shaft aft of the main spar for rotation with the drive shaft, wherein the leading rib defines leading segments of the aerodynamic lower profile edge and aerodynamic upper profile edge of the respective rib unit and the trailing rib defines trailing segments of the aerodynamic lower profile edge and aerodynamic upper profile edge of the respective rib unit.

6. The wingsail of claim 5, wherein the trailing segments of the aerodynamic lower profile edges are concave.

7. The wingsail of claim 5, wherein each rib unit comprises a thrust bushing configured so that the leading rib and trailing rib are movable in relation to one another along the axis of rotation in a limited range of axial motion to adjust the rib unit between a retracted configuration and an extended configuration.

8. The wingsail of claim 7, further comprising a cam mechanism for each rib unit, each cam mechanism configured to control movement of the leading rib and trailing rib in relation to one another by cam action as the rib unit rotates about the axis of rotation from the port wind position to the starboard wind position, wherein the cam mechanism is configured to adjust the rib unit to the extended configuration in the port wind position and the starboard wind position to tension the sailcloth, wherein the cam mechanism is configured to adjust the rib unit to the retracted configuration at angular positions about the axis of rotation between the port wind position and the starboard wind position to relax the sailcloth.

9. The wingsail of claim 8, wherein each cam mechanism comprises a fixed cam mounted on the main spar adjacent the respective rib unit, wherein each rib unit comprises a follower surface configured for camming engagement with the respective fixed cam as the rib unit rotates about the axis of rotation between the port wind position and the starboard wind position.

10. The wingsail of claim 9, wherein each cam mechanism further comprises a stop for the respective rib unit configured to stop rotation of the respective rib unit in a first rotational direction at the port wind position and to stop rotation of the respective rib unit in a second rotational direction at the starboard wind position.

11. The wingsail of claim 10, wherein each cam mechanism further comprises a cam rotor for each rib unit, each cam rotor mounted on the main spar for rotation with respect to the main spar about the axis of rotation for the respective rib unit, wherein each cam rotor comprises a detent feature and a cam surface, wherein the cam mechanism of each rib unit further comprises a detent follower configured to releasably engage the detent feature of the respective cam rotor to link the rib unit to the cam rotor for rotation with the cam rotor about the axis of rotation when the rib unit is in the retracted configuration.

12. The wingsail of claim 11, wherein each cam mechanism is configured so that the respective rib unit is in the retracted configuration and the detent follower engages the detent feature to link the rib unit to the cam rotor for rotation with the cam rotor whenever the rib unit is at any rotational position between the port wind position and the starboard wind position;

wherein from any rotational position between the port wind position and the starboard wind position:

(i) the cam rotor is rotatable in the first rotational direction to a port-side rib stop position at which the fixed cam extends the rib unit to disengage the detent follower from the detent feature by camming engagement with the follower and rotation of the rib unit is stopped at the port wind position by the respective stop, and further from the port-side rib stop position to a port-side rotor stop position; wherein as the cam rotor rotates in the first rotational direction from the port-side rib stop position to the port-side rotor stop position, the cam surface cams the detent follower to further extend the rib unit to the extended configuration without rotating the rib unit; and (ii) the cam rotor is rotatable in the second rotational direction to a starboard-side rib stop position at which the fixed cam extends the rib unit to disengage the detent follower from the detent feature by camming engagement with the follower and rotation of the rib unit is stopped at the starboard wind position by the respective stop, and further from the starboard-side rib stop position to a starboard-side rotor stop position; wherein as the cam rotor rotates in the second rotational direction from the starboard-side rib stop position to the starboard-side rotor stop position, the cam surface cams the detent follower to further extend the rib unit to the extended configuration without rotating the rib unit.

13. The wingsail of claim 12, wherein each detent feature comprises a groove, each cam surface comprises ramps on opposite sides of the groove, and each detent follower comprises a pin mounted on the drive shaft and extending radially with respect to the axis of rotation.

14. The wingsail of claim 13, wherein each cam rotor is a sprocket and wherein the wingsail further comprises a chain or belt for connecting each sprocket to a prime mover.

15. The wingsail of claim 5, further comprising a leading edge spar and a trailing edge spar, wherein each leading rib is operably coupled to the leading edge spar and each trailing rib is operably coupled to the trailing edge spar.

16. The wingsail of claim 15, wherein the leading edge spar comprises a track for each rib unit, each track extending generally spanwise, wherein each rib unit comprises a leading roller assembly mounted on the leading rib, each leading roller assembly comprising a roller received in the track so the track constrains the roller to roll along the track, the track and roller forming a track-and-roller coupling that couples the leading rib to the leading edge spar so that the leading edge spar follows the rib units as the rib units rotate about their rotational axes.

17. The wingsail of claim 16, further comprising a plurality of riblets mounted on the leading edge spar for movement with the leading edge spar, the riblets shaping the sailcloth at a leading edge portion of the wingsail.

18. The wingsail of claim 15, wherein the trailing edge spar comprises a plate having an edge margin forming a roller guide extending along the spanwise axis, wherein each rib unit comprises a trailing roller assembly mounted on the trailing rib, each trailing roller assembly comprising a roller having a channel-shaped bearing surface, the roller guide being received in the channel-shaped bearing surface of each roller so that the roller guide constrains the roller to roll along the roller guide, the roller guide and each roller forming a roller edge coupling that couples the trailing rib to the trailing edge spar so that the trailing edge spar follows the rib units as the rib units rotate about their rotational axes.

19. The wingsail of claim 15, further comprising a trailing edge camber linkage the trailing edge spar on the main spar and a leading edge camber linkage supporting the leading edge spar on the main spar, the trailing edge camber linkage configured so the trailing edge spar is rotatable with respect to the main spar about a first hinge axis and is adjustable radially of the first hinge axis, the leading edge camber linkage configured so that the leading edge spar is rotatable with respect to the main spar about a second hinge axis and adjustable radially of the second hinge axis.

20. A sailboat comprising a hull and the wingsail of claim 1 upstanding from the hull.

21. The sailboat of claim 20, further comprising an air rudder aft of the wingsail.

22. The sailboat of claim 21, further comprising a stabilizer arm mounted on the main spar, the stabilizer arm having a forward end portion and an aft end portion, the air rudder supported on the aft end portion.

23. The sailboat of claim 22, further comprising a counterbalance weight supported on the forward end portion of the stabilizer arm.

24. The sailboat of claim 21, wherein the air rudder comprises a main stabilizer body and a controllable trim tab aft of the main stabilizer body.

25. A reversible camber wingsail, the wingsail having a spanwise axis, a port side and a starboard side, the wingsail comprising:

a spar extending along the spanwise axis, the wingsail having a chordwise axis transverse to the spanwise axis;

a plurality of rib units connected to the spar at spaced apart locations along the spanwise axis, each rib unit having a respective axis of rotation and being rotatable about the axis of rotation from a port wind position to a starboard wind position, each axis of rotation extending chordwise;

a sailcloth comprising a port side sheet portion and starboard side sheet portion, the sailcloth covering the plurality of rib units such that the rib units are received between the port side sheet portion and the starboard side sheet portion; wherein when the rib units are rotated to the port wind positions, the sailcloth forms on the rib units to define a first airfoil shape; wherein when the rib units are rotated to the starboard wind positions, the sailcloth forms on the rib units to define a second airfoil shape, the first airfoil shape and the second airfoil shape having opposite cambers; and a cam mechanism for each rib unit configured to extend and retract the respective rib unit by cam action as the rib unit rotates about the respective axis of rotation, wherein the cam mechanism is configured to retract the rib unit at angular positions about the axis of rotation between the port wind position and the starboard wind position to relax the sailcloth and extend the rib unit at the port wind position and the starboard wind position to tension the sailcloth.

26. The wingsail of claim 25, wherein each rib unit is rotatable to a neutral position between the respective port wind position and the respective starboard wind position; wherein when the rib units are oriented in the neutral positions, the wingsail is symmetrical on opposite sides of a plane defined by the spanwise axis and a chordwise axis of the wingsail.

* * * * *